US008152156B2

(12) United States Patent
Terada

(10) Patent No.: US 8,152,156 B2
(45) Date of Patent: Apr. 10, 2012

(54) ROTATION-BODY CONTROLLING APPARATUS, SHEET FEEDING APPARATUS, AND IMAGE RECORDING APPARATUS

(75) Inventor: Kohei Terada, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 316 days.

(21) Appl. No.: 12/552,433

(22) Filed: Sep. 2, 2009

(65) Prior Publication Data

US 2010/0059926 A1 Mar. 11, 2010

(30) Foreign Application Priority Data

Sep. 9, 2008 (JP) ..... 2008-230513

(51) Int. Cl.
*B65H 5/00* (2006.01)

(52) U.S. Cl. ..... 271/10.13; 271/10.04; 271/10.05

(58) Field of Classification Search ..... 271/10.04, 271/10.05, 10.09, 10.11, 10.13
See application file for complete search history.

(56) References Cited

U.S. PATENT DOCUMENTS

| | | | | |
|---|---|---|---|---|
| 5,344,134 | A * | 9/1994 | Saeki et al. | 271/122 |
| 5,462,267 | A * | 10/1995 | Hori | 271/10.04 |
| 5,749,570 | A * | 5/1998 | Iwata et al. | 271/10.13 |
| 6,334,725 | B1 * | 1/2002 | Miyauchi | 400/624 |
| 6,974,127 | B2 * | 12/2005 | Kang | 271/10.11 |
| 7,060,969 | B2 * | 6/2006 | Uchiyama et al. | 250/231.16 |
| 7,431,283 | B2 * | 10/2008 | Hsieh | 271/110 |
| 7,959,147 | B2 * | 6/2011 | Izuchi et al. | 271/9.02 |
| 2005/0082739 | A1 * | 4/2005 | Mitsuya et al. | 271/10.11 |
| 2007/0126168 | A1 * | 6/2007 | Silverbrook et al. | 271/10.09 |

FOREIGN PATENT DOCUMENTS

| | | | |
|---|---|---|---|
| JP | S63-236651 | A | 10/1988 |
| JP | H04-275898 | A | 10/1992 |
| JP | H10-038902 | A | 2/1998 |
| JP | 2005-168280 | A | 6/2005 |
| JP | 2005-212272 | A | 8/2005 |
| JP | 2006-224380 | A | 8/2006 |
| JP | 2007-161389 | A | 6/2007 |
| JP | 2007-197186 | A | 8/2007 |
| JP | 2007-326245 | A | 12/2007 |
| JP | 2008-044767 | A | 2/2008 |

OTHER PUBLICATIONS

Japan Patent Office, Notification of Reason for Refusal for Japanese Patent Application No. 2008-230513 (counterpart to above-captioned patent application), mailed Jul. 13, 2010.

* cited by examiner

*Primary Examiner* — Kaitlin Joerger
*Assistant Examiner* — Prasad Gokhale
(74) *Attorney, Agent, or Firm* — Baker Botts, L.L.P.

(57) ABSTRACT

A rotation-body controlling apparatus including: a first motor configured to rotate a first rotation body; a second motor configured to rotate a second rotation body; a first rotation amount detecting portion configured to detect a rotation amount of the first rotation body rotated in synchronization with the first motor; a second rotation amount detecting portion configured to detect a rotation amount of a second rotation shaft rotated in synchronization with the second rotation body; a transmitting mechanism configured such that a rotation of the first rotation body is transmittable to the second rotation shaft; and an origin-position detecting portion configured to detect an origin position of a rotation phase of the first rotation body on the basis of a phase of the first rotation body at a time when the second rotation amount detecting portion has detected a rotation of the second rotation shaft, where the rotation of the first rotation body operated by the first motor is transmitted to the second rotation shaft via the transmitting mechanism.

15 Claims, 15 Drawing Sheets

ROTATION-BODY CONTROLLING APPARATUS, SHEET FEEDING APPARATUS, AND IMAGE RECORDING APPARATUS

CROSS REFERENCE TO RELATED APPLICATION

The present application claims priority from Japanese Patent Application No. 2008-230513, which was filed on Sep. 9, 2008, the disclosure of which is herein incorporated by reference in its entirety.

BACKGROUND OF THE INVENTION

1. Field of the Invention

The present invention relates to a rotation-body controlling apparatus including an origin-position detecting portion for detecting an origin position of a rotation phase of a rotation body without upsizing of the apparatus and increase in cost, a sheet feeding apparatus including the rotation-body controlling apparatus, and an image recording apparatus configured to record a non-distorted beautiful image on a sheet.

2. Description of the Related Art

A printer and a scanner include a sheet feeding apparatus for feeding a sheet such as a document. The sheet feeding apparatus includes a roller driven to be rotated in a state in which the roller is held in contact with the sheet. In order to record a non-distorted beautiful image on a recording sheet, and to realize image reading of a document with high image quality, the sheet is fed by receiving a rotational force of this roller. There is a need to accurately control a feeding amount of the sheet. However, in the sheet feeding apparatus, a rotation amount of the roller may not be accurately controlled because of an error of mounting of a sensor for detecting the rotation amount of the roller, an error of attachment of a gear to the roller, and so on. Further, even where the rotation amount of the roller is accurately controlled, feeding of the sheet may not be even because of an error of manufacturing of the roller. Thus, in the sheet feeding apparatus, the feeding amount of the sheet is periodically changed because of these errors. In a conventional sheet feeding apparatus, there is provided a means for correcting the feeding amount of the sheet by detecting the periodical change of the feeding amount of the sheet (for example, with reference to Patent Documents 1-4).

An ink-jet recording apparatus disclosed in Patent Document 3 (JP-A-2006-224380) records an image on a sheet while correcting a rotation amount of a roller on the basis of a result of detection of the rotation amount of the roller by a rotary encoder. Where the rotation amount of the roller is preferably corrected, a pattern whose concentration change is small is recorded on the sheet. In contrast, where the rotation amount of the roller is not appropriately corrected, a pattern whose concentration change is large is recorded on the sheet. In the ink-jet recording apparatus, a plurality of patterns are recorded on the sheet while changing an amount of correction of the rotation amount of the roller, and then a correction value of the rotation amount of the roller in one of the patterns whose evenness in the concentration is the smallest is obtained and stored into a memory. Then, the rotation amount of the roller is corrected on the basis of this correction value.

Patent Document 1 (JP-A-10-38902) discloses a means for eliminating an effect of an eccentricity of an encoder disc from a rotation speed of a roller which has been detected by a rotary encoder. A rotation-speed detecting device disclosed in this document includes a phase detecting rotational circular disc and an optical sensor. The phase detecting rotational circular disc is a disc on which one light detecting area is provided, and fixed to a rotation shaft of the roller with the encoder disc. The optical sensor includes a light emitting element and a light receiving element which are disposed so as to be opposed to each other at a predetermined distance with an outer edge of the phase detecting rotational circular disc interposed therebetween. One pulse signal is outputted from the optical sensor in each rotation of the roller, and an origin position of the rotation shaft of the roller is identified on the basis of this pulse signal. The periodical change of the feeding amount of the sheet which is generated with one rotation of the roller being as one cycle is grasped on the basis of the origin position, and the rotation of the roller is controlled such that the periodical change is balanced out.

A rotation controlling apparatus disclosed in Patent Document 2 (U.S. Pat. No. 7,060,969 B2 corresponding to JP-A-2005-168280) includes three rotation sensors for detecting a rotation of a rotary encoder. Each of the rotation sensors includes a light emitting element and a light receiving element which are disposed so as to be opposed to each other with a predetermined space interposed therebetween. An encoder disc of each rotary encoder is fixed to an output shaft of a motor. Each rotation sensor is disposed such that an outer edge of the encoder disc is located in the space, and is arranged at a right angle with respect to a circumferential direction of the encoder disc. In the rotation controlling apparatus, a rotation speed of the output shaft of the motor is calculated by performing a predetermined computing processing for an output signal outputted from each rotation sensor. Then, a rotation of the motor is controlled such that the rotation speed coincides with a target rotation speed.

In a sheet feeding apparatus disclosed in Patent Document 4 (JP-A-2007-197186), a target rotation amount of a sheet-feed roller is corrected on the basis of a correction value obtained by a computation, whereby a periodic deviation of a rotation amount of the sheet-feed roller is balanced out. Further, in this sheet feeding apparatus, a current rotation phase of the sheet-feed roller is determined with a position of the sheet-feed roller at a time when a constant-speed rotation of the sheet-feed roller is finished being as a reference position. Then, where the sheet-feed roller is rotated, the current rotation phase of the sheet-feed roller is updated in accordance with the rotation amount of the sheet-feed roller with respect to the reference position.

SUMMARY OF THE INVENTION

Meanwhile, the apparatus disclosed in Patent Document 3 needs to record a pattern on a sheet in each time when a power of the apparatus is turned on and to obtain the correction value because information about an origin position of a rotation phase of the roller is lost when the power of the apparatus is turned off. In contrast, the device disclosed in Patent Document 1 can easily detect the origin position of the rotation phase of the roller on the basis of the pulse signal which is outputted from the optical sensor when a power of the device is turned on, and the apparatus disclosed in Patent Document 2 does not need to perform such a cumbersome processing performed in the apparatus disclosed in Patent Document 3 because the apparatus disclosed in Patent Document 2 does not need to detect the origin position. However, since the device disclosed in Patent Document 1 requires the phase detecting rotational circular disc and the optical sensor for detecting the origin position, and the apparatus disclosed in Patent Document 2 requires the three rotation sensors, there is another problem in which upsizing of the apparatus and increase in cost are caused. Further, the apparatus disclosed in Patent Document 2 can eliminate an effect of deviation of a central position of the rotary encoder on the basis of the rotation speed of the output shaft of the motor but cannot correct, in a configuration of the apparatus, other eccentricities such as an eccentricity of the output shaft of the motor.

In contrast, in the apparatus in Patent Document 4, since the current rotation phase of the sheet-feed roller is obtained by the computation, there is no need to include a device for detecting an origin position of the rotation phase of the sheet-feed roller, and thus the apparatus can be constructed in reduced cost. However, since the current rotation phase of the sheet-feed roller is obtained by the computation, an accuracy of feeding the sheet is not sufficient for recording a beautiful image on the sheet.

This invention has been developed in view of the above-described problems, and it is an object of the present invention to provide a rotation-body controlling apparatus including an origin-position detecting portion for detecting an origin position of a rotation body without upsizing of the apparatus and increase in cost, a sheet feeding apparatus including the rotation-body controlling apparatus, and an image recording apparatus configured to record a non-distorted beautiful image on a sheet.

The object indicated above may be achieved according to the present invention which provides a rotation-body controlling apparatus comprising: a first motor configured to rotate a first rotation body; a second motor configured to rotate a second rotation body; a first rotation amount detecting portion configured to detect a rotation amount of the first rotation body rotated in synchronization with the first motor; a second rotation amount detecting portion configured to detect a rotation amount of a second rotation shaft rotated in synchronization with the second rotation body; a transmitting mechanism configured such that a rotation of the first rotation body is transmittable to the second rotation shaft; and an origin-position detecting portion configured to detect an origin position of a rotation phase of the first rotation body on the basis of a phase of the first rotation body at a time when the second rotation amount detecting portion has detected a rotation of the second rotation shaft, where the rotation of the first rotation body operated by the first motor is transmitted to the second rotation shaft via the transmitting mechanism.

In the rotation-body controlling apparatus constructed as described above, since the origin position of the rotation phase of the first rotation body is detected by the second rotation amount detecting portion configured to detect the rotation amount of the second rotation shaft, there is no need to provide a member for detecting the origin position of the first rotation body. Thus, the origin position of the first rotation body can be detected while restraining upsizing of the apparatus and increase in cost.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which:

FIG. 10A is a schematic view of a first encoder disc 71 and an optical sensor 55 while FIG. 10B is a graph showing an example of the feeding amount of the recording sheet 50 per a pulse signal outputted from a first rotary encoder 81;

FIG. 13 is a flow-chart indicating an example of a procedure of a processing performed by the MFD 10 when the MFD 10 is turned on;

DESCRIPTION OF THE EMBODIMENT

Hereinafter, there will be described an embodiment of the present invention by reference to the drawings. It is to be understood that the following embodiment is described only by way of example, and the invention may be otherwise embodied with various modifications without departing from the scope and spirit of the invention.

<General Structure of MFD 10>

Figure 1:
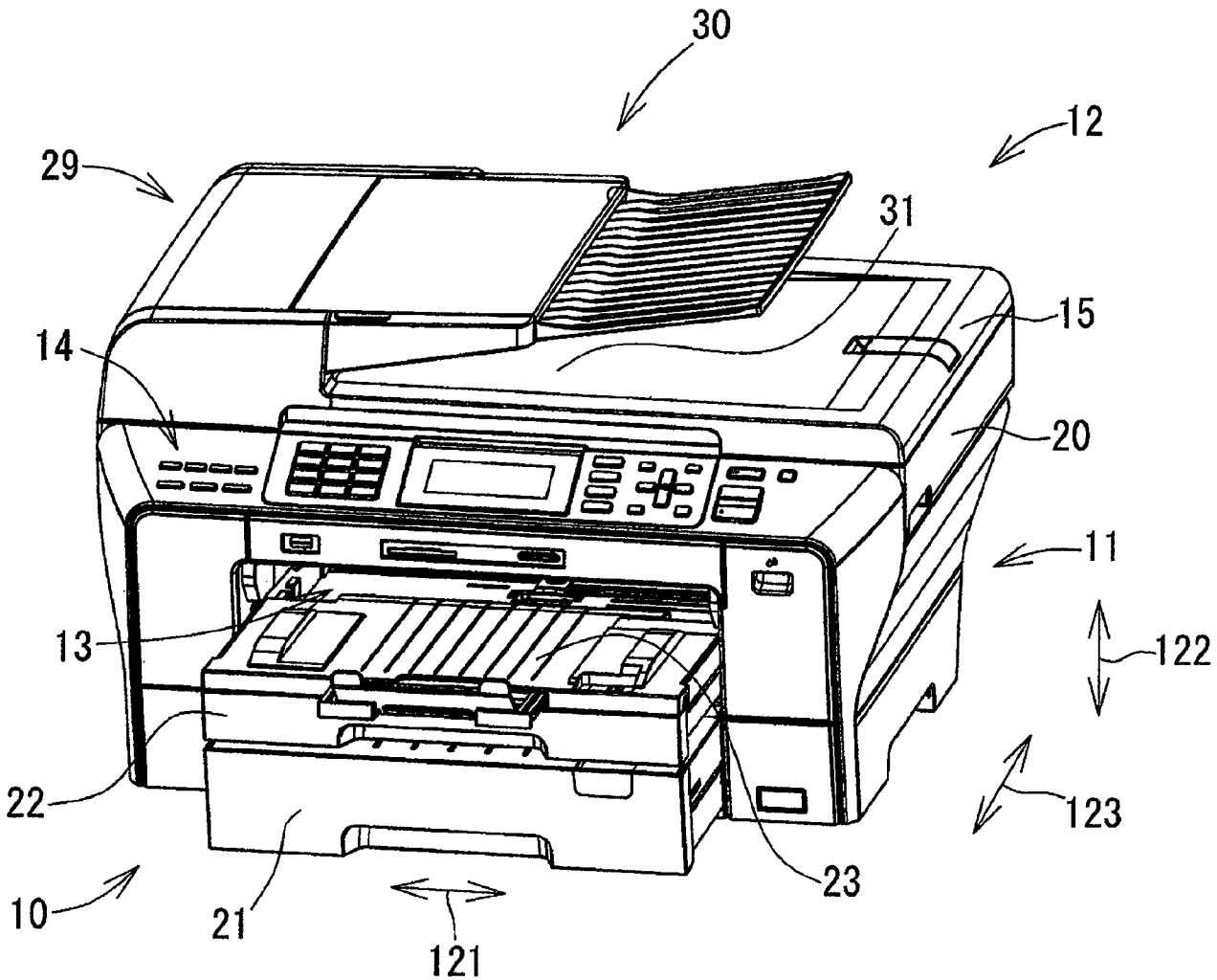
FIG. 1 is a perspective view showing an external construction of a multi-function device (MFD) 10 as an embodiment of the present invention.

As shown in FIG. 1, a multi-function device (MFD) 10 includes a printer section 11 and a scanner section 12 integrally with each other and has a printing function, a scanning function, a copying function, and a facsimile function. The printer section 11 corresponds to an image recording apparatus to which the present invention is applied. It is noted that the MFD 10 may not include the scanner section 12 and may be a single-function printer not having, e.g., the scanning function and the copying function as the image recording apparatus to which the present invention is applied.

The MFD 10 is wide and slim type with its dimensions in a width direction 121 and a depth direction 123 made larger than its dimension in a height direction 122 and has a generally wide and flat rectangular parallelepiped shape. The scanner section 12 is provided at an upper portion of the MFD 10. The scanner section 12 includes a document table 20 and a document cover 15. The document table 20 functions as what is called a flat-bed scanner. The document cover 15 is openable and closable with respect to the document table 20 and functions as a top plate of the MFD 10. A contact glass, not shown, is provided on an upper surface of the document table 20. A line sensor extending in the depth direction 123 is movably disposed in the document table 20. An image of a document placed on the contact glass is read by this line sensor.

An auto document feeder (AFD) 29 is provided on the document cover 15. The AFD 29 feeds the document placed on a document tray 30 to a document-discharge tray 31 through a sheet-feed path, not shown. In a process in which the document is fed by the AFD 29, the image of the document is read by the line sensor disposed at a predetermined reading position in a stationary state.

The printer section 11 is provided at a lower portion of the MFD 10. An opening 13 is formed in the front side of the printer section 11. A sheet-supply cassette (a first sheet placed portion) 21 and a sheet-supply cassette (a second sheet placed portion) 22 are inserted into the printer section 11 through the opening 13, so that the sheet-supply cassette 21 and the sheet-supply cassette 22 are disposed in a vertical direction. At least one rectangular recording sheet 50 of standard-size (with reference to FIG. 2) is placed on the sheet-supply cassettes 21, 22. In the printer section 11, the recording sheet 50 is selectively supplied from the sheet-supply cassette 21 or the sheet-supply cassette 22 into a recording portion 40 (with reference to FIG. 2). The image is recorded on the recording sheet 50 by the recording portion 40, and then the recording sheet 50 is discharged onto an upper surface 23 of the sheet-supply cassette 22. That is, the upper surface 23 functions as what is called a sheet-discharge tray.

The MFD 10 is used in a state in which the MFD 10 is connected to an external information device, not shown, mainly such as a computer. The printer section 11 records the image on the recording sheet 50 on the basis of data such as printing data received from the external information device and image data of the document which is read by the scanner section 12.

An operation panel 14 is provided on a front upper face of the MFD 10. The operation panel 14 is provided with (a) a display for displaying various information and (b) input keys or buttons for a user to input information. The MFD 10 is operated on the basis of command information inputted from the operation panel 14 or command information transmitted from the external information device through a printer driver, a scanner driver, and so on.

<Printer Section 11>

Figure 2:
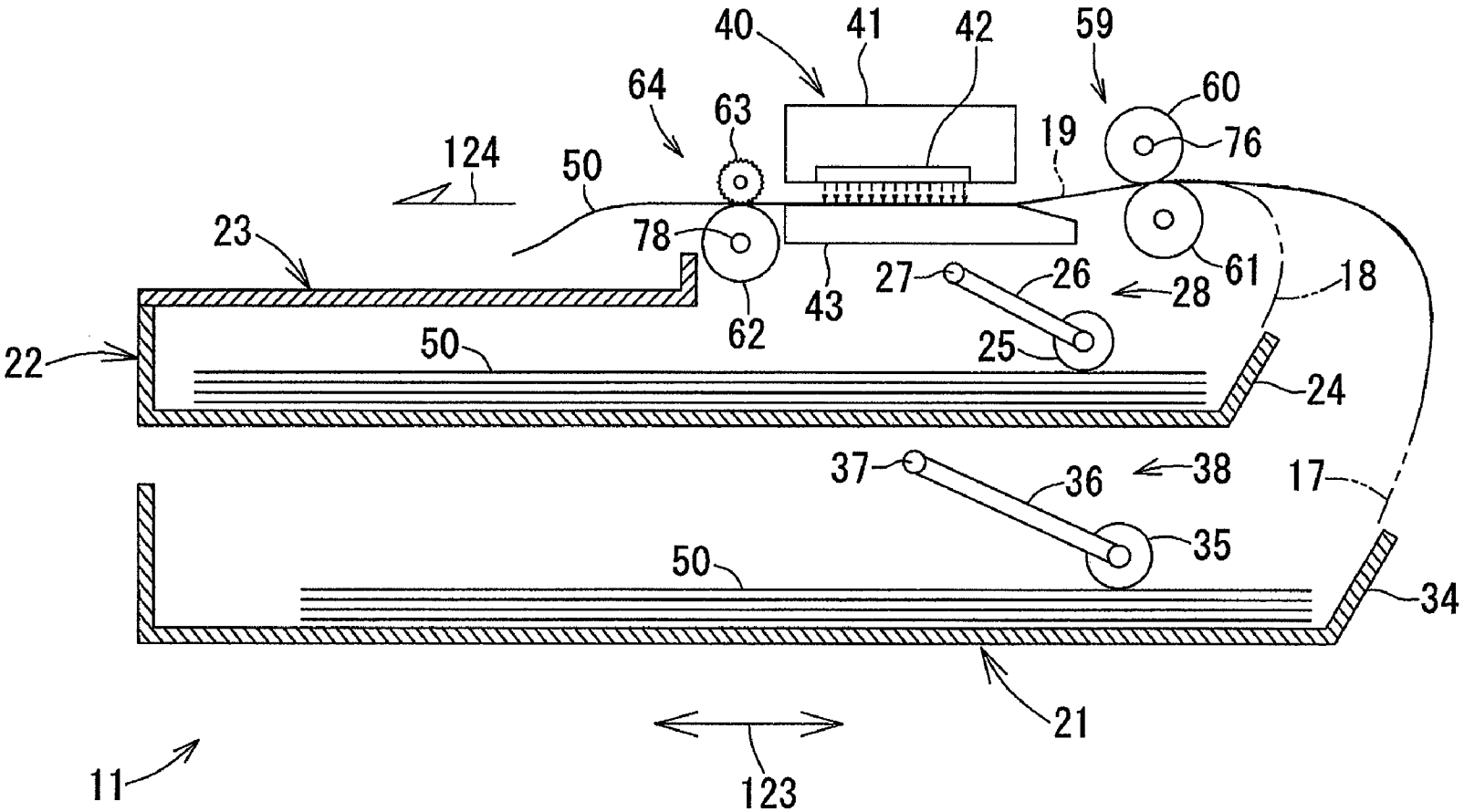
FIG. 2 is a schematic view showing an internal structure of a printer section 1.

Hereinafter, there will be explained a structure of the printer section 11 with reference to FIGS. 2-8. When broadly divided, the printer section 11 includes the sheet-supply cassettes 21, 22, a first supplying portion 28, a second supplying portion 38, the recording portion 40, an auto sheet feed (ASF) motor (a second motor) 84, a pair of sheet-feed rollers 59, a pair of sheet-discharge rollers 64, a line feed (LF) motor (a first motor) 85, a second rotary encoder (a second rotation amount detecting portion) 82, a first rotary encoder 81, and a drive-power transmitting mechanism 90. In the present embodiment, a rotation-body controlling apparatus and a sheet feeding apparatus to which the present invention is applied are constituted by the first supplying portion 28, the second supplying portion 38, the ASF motor 84, the pair of sheet-feed rollers 59, the pair of sheet-discharge rollers 64, the LF motor 85, the second rotary encoder 82, the first rotary encoder 81, the drive-power transmitting mechanism 90, and a controller 100 which will be described below. It is noted that the sheet-supply cassette 21 and the sheet-supply cassette 22 in FIG. 2 are depicted by conceptually simplifying actual shapes thereof and thus are different from the actual shapes. Further, in FIG. 2, a first encoder disc 71 and an optical sensor 55 are omitted.

The sheet-supply cassette 22 is a container partly opening in a back side of the MFD 10 (i.e., on a right side in FIG. 2). The recording sheets 50 may be placed in an inner space of the sheet-supply cassette 22 in a state in which the recording sheets 50 are stacked on each other. The sheet-supply cassette 22 can accommodate the recording sheets 50 of various sizes smaller than A3 Size such as A4 Size, B5 Size, Postcard Size, and the like, for example. The upper surface 23 of the sheet-supply cassette 22 is provided in a front portion of the MFD 10 (a left portion in FIG. 2).

The sheet-supply cassette 21 is a container partly opening in the back side of the MFD 10. The recording sheets 50 may be placed in an inner space of the sheet-supply cassette 21 in a state in which the recording sheets 50 are stacked on each other. The sheet-supply cassette 21 can accommodate the recording sheets 50 of various sizes smaller than A3 Size such as A4 Size, B5 Size, Postcard Size, and the like, for example. The recording sheet(s) 50 whose size and type are different from those of the recording sheet(s) 50 accommodated in the sheet-supply cassette 22 is or are accommodated in the sheet-supply cassette 21, whereby two types of the recording sheets 50 can be used without replacement of the recording sheets 50.

<First Supplying Portion 28>

A sheet-feed path 18 formed so as to have a curved shape is provided on an upper side of an inclined plate 24 of the sheet-supply cassette 22. When the sheet-supply cassette 22 is inserted into the printer section 11, the inclined plate 24 is disposed under the sheet-feed path 18, and the first supplying portion 28 is disposed above the sheet-supply cassette 22. The first supplying portion 28 includes a sheet-supply roller (a second rotation body, a first supplying roller) 25, an arm 26, and a shaft 27. The sheet-supply roller 25 is rotatably provided on a distal end of the arm 26. The arm 26 is pivotably provided on the shaft 27 supported by a casing of the printer section 11. The arm 26 is pivotably biased toward the sheet-supply cassette 22 by its own weight or an elastic force of, e.g., a spring.

<Second Supplying Portion 38>

A sheet-feed path 17 formed so as to have a curved shape is provided on an upper side of an inclined plate 34 of the sheet-supply cassette 21. When the sheet-supply cassette 21 is inserted into the printer section 11, the inclined plate 34 is disposed under the sheet-feed path 17, and the second supplying portion 38 is disposed above the sheet-supply cassette 21. The second supplying portion 38 includes a sheet-supply roller (the second rotation body, a second supplying roller) 35, an arm 36, and a shaft 37. The sheet-supply roller 35 is rotatably provided on a distal end of the arm 36. The arm 36 is pivotably provided on the shaft 37 supported by the casing of the printer section 11. The arm 36 is pivotably biased toward the sheet-supply cassette 21 by its own weight or an elastic force of, e.g., a spring.

<ASF Motor 84>

Figure 4:
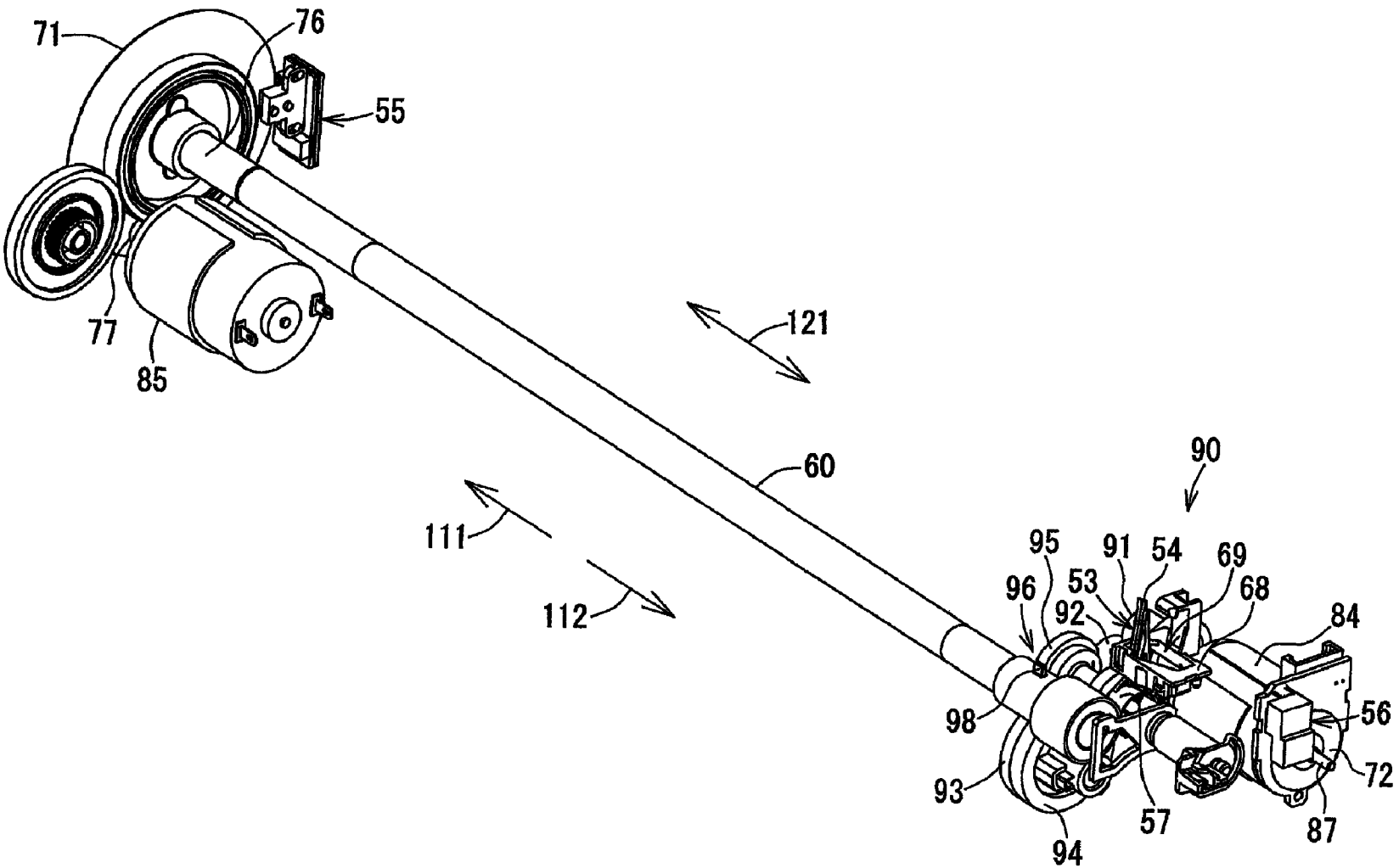
FIG. 4 is a perspective view showing an external structure of a drive-power transmitting mechanism 90.
Figure 5:
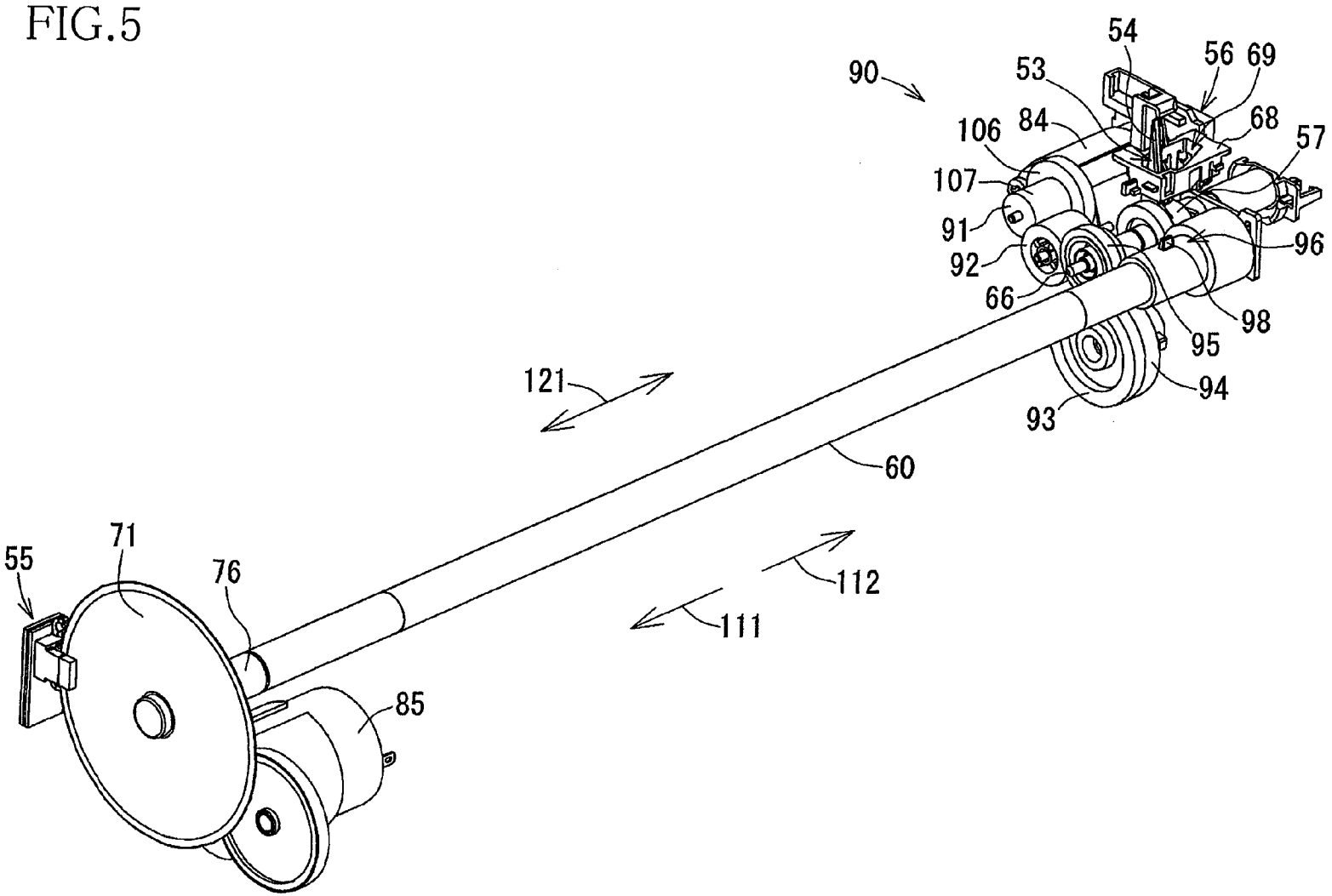
FIG. 5 is a perspective view showing the external structure of the drive-power transmitting mechanism 90 as seen from a side different from that in FIG. 4.

As shown in FIGS. 4 and 5, the printer section 11 includes the ASF motor 84 which rotates the sheet-supply roller 25 and the sheet-supply roller 35 while controlling rotations thereof. The ASF motor 84 includes a DC motor, for example. A drive power of the ASF motor 84 is selectively transmitted to the sheet-supply roller 25 and the sheet-supply roller 35 by the drive-power transmitting mechanism 90 which will be described below.

In the printer section 11, there is provided a sheet-feed path 19 continuous to the sheet-feed path 18 and the sheet-feed path 17. The sheet-feed path 19 is a path through which the recording sheet 50 fed along the sheet-feed path 18 or the sheet-feed path 17 is fed. The sheet-feed path 19 extends from a position at which the sheet-feed path 18 and the sheet-feed path 17 are joined into one toward the front side of the MFD 10 to a position above the upper surface 23 of the sheet-supply cassette 22.

Where the recording sheet 50 is supplied from the sheet-supply cassette 22 toward the sheet-feed paths 18, 19, the drive power of the ASF motor 84 is transmitted to the sheet-supply roller 25 via a power transmitting mechanism, not shown, provided on the shaft 27, the arm 26, and the drive-power transmitting mechanism 90 which will be described below. As a result, the sheet-supply roller 25 is rotated. An uppermost one of the recording sheet(s) 50 in the sheet-supply cassette 22 is fed toward the sheet-feed path 18 along the inclined plate 24 by receiving a rotational force of the sheet-supply roller 25.

Where the recording sheet 50 is supplied from the sheet-supply cassette 21 toward the sheet-feed paths 17, 19, the drive power of the ASF motor 84 is transmitted to the sheet-supply roller 35 via a power transmitting mechanism, not shown, provided on the shaft 37, the arm 36, and the drive-power transmitting mechanism 90. As a result, the sheet-supply roller 35 is rotated. An uppermost one of the recording sheet(s) 50 in the sheet-supply cassette 21 is fed toward the sheet-feed path 17 along the inclined plate 34 by receiving a rotational force of the sheet-supply roller 35. As thus described, the drive power of the ASF motor 84 is transmitted to the sheet-supply roller 25 or the sheet-supply roller 35, whereby the recording sheet 50 is selectively supplied from the sheet-supply cassette 22 or the sheet-supply cassette 21 to the sheet-feed path 19.

Figure 3:
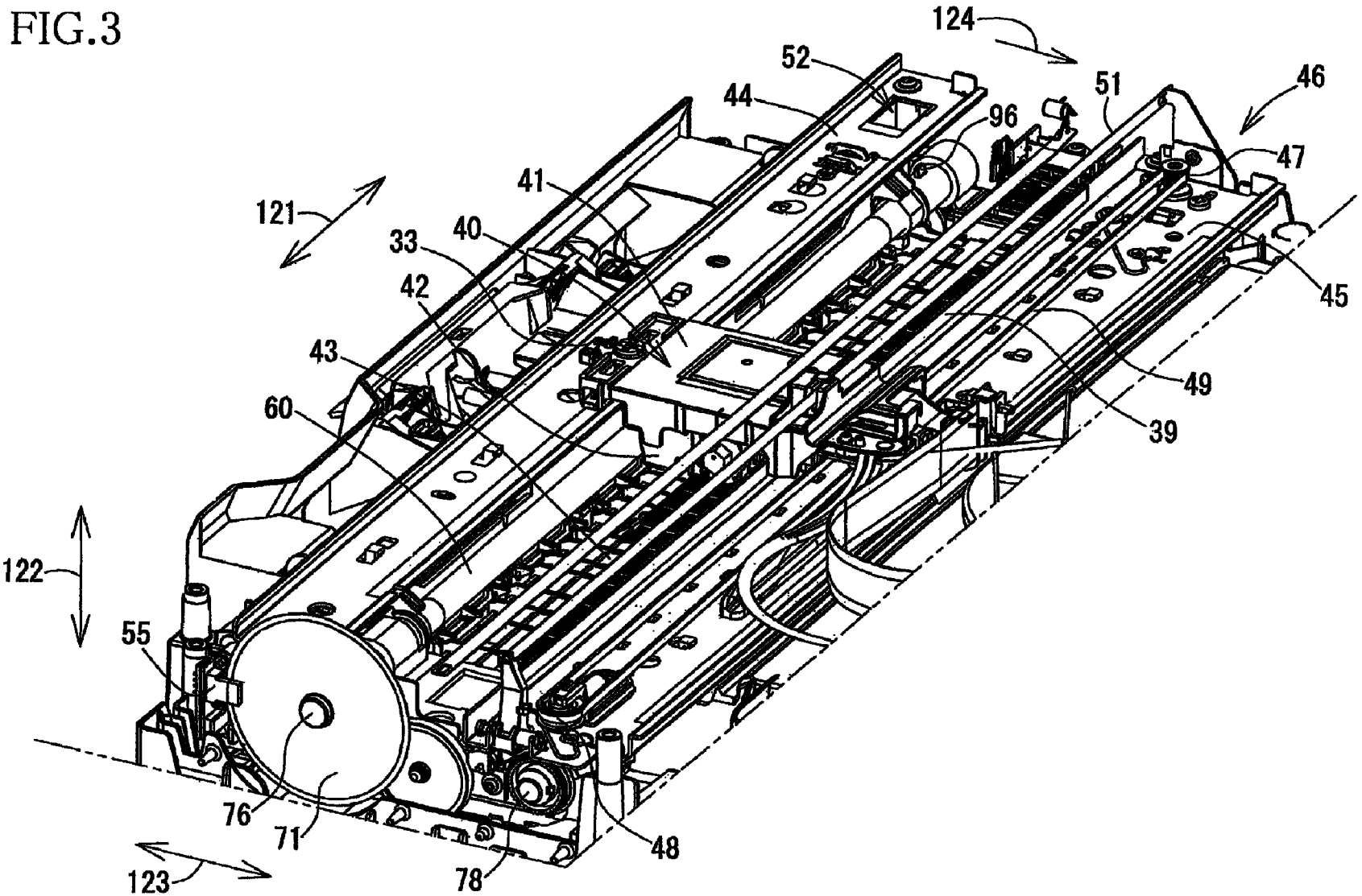
FIG. 3 is a partially enlarged perspective view showing an internal structure of the printer section 11.

As shown in FIGS. 2 and 3, a platen 43 is provided on the sheet-feed path 19. The platen 43 supports a lower surface of the recording sheet 50 fed along the sheet-feed path 19. The recording portion 40 is disposed above the platen 43. This recording portion 40 will be explained below.

<Pair of Sheet-feed Rollers 59>

The pair of sheet-feed rollers 59 are provided on an upstream side of the platen 43 in a sheet-feed direction 124 in which the recording sheet 50 is fed. The pair of sheet-feed rollers 59 are constituted by a sheet-feed roller (a first rotation body) 60 and a pinch roller 61. The sheet-feed roller 60 is provided on an upper side of the sheet-feed path 19 and rotated by receiving a drive power from the LF motor 85 (with reference to FIGS. 4 and 5). The pinch roller 61 is rotatably disposed under the sheet-feed roller 60 with the sheet-feed path 19 interposed therebetween, and biased by a spring toward the sheet-feed roller 60.

<Pair of Sheet-discharge Rollers 64>

The pair of sheet-discharge rollers 64 are provided on a downstream side of the platen 43 in the sheet-feed direction 124 of the recording sheet 50. The pair of sheet-discharge rollers 64 are constituted by a sheet-discharge roller 62 and a spur 63. The sheet-discharge roller 62 is provided on a lower side of the sheet-feed path 19 and rotated by receiving the drive power from the LF motor 85. The spur 63 is rotatably disposed on an upper side of the sheet-discharge roller 62 with the sheet-feed path 19 interposed therebetween, and biased by a spring toward the sheet-discharge roller 62.

<LF Motor 85>

The LF motor 85 (with reference to FIGS. 4 and 5) is provided in the printer section 11. The LF motor 85 rotates the sheet-feed roller 60 and the sheet-discharge roller 62 while controlling rotations thereof. The LF motor 85 includes the DC motor, for example. A shaft 77 of the LF motor 85 is connected to a shaft 76 of the sheet-feed roller 60 and a shaft 78 of the sheet-discharge roller 62 via gears and pulleys, not shown. Thus, the drive power of the LF motor 85 is transmitted to both of the shaft 76 and the shaft 78. As a result, the sheet-feed roller 60 and the sheet-discharge roller 62 are rotated in synchronization with each other. Thus, the sheet-discharge roller 62 and the spur 63 are rotated simultaneously with the sheet-feed roller 60 and the pinch roller 61. The sheet-feed roller 60 and the sheet-discharge roller 62 are intermittently driven by the LF motor 85 when image recording is performed by the recording portion 40. The intermittent driving is a drive mode in which are alternatively repeated (a) continuous driving of the LF motor 85 performed until the sheet-feed roller 60 and the sheet-discharge roller 62 are rotated by a rotation amount corresponding to a predetermined target feeding amount and (b) stopping of the LF motor 85 for a predetermined period of time since the target feeding amount has reached.

When the recording sheet 50 supplied to the sheet-feed path 19 has reached a position between the sheet-feed roller 60 and the pinch roller 61, the recording sheet 50 is fed onto the platen 43 by receiving a rotational force of the sheet-feed roller 60, in a state in which the recording sheet 50 is nipped by the sheet-feed roller 60 and the pinch roller 61. When this recording sheet 50 has reached a position between the sheet-discharge roller 62 and the spur 63, the recording sheet 50 is fed to the position above the sheet-supply cassette 22 by receiving a rotational force of the sheet-discharge roller 62, in a state in which the recording sheet 50 is nipped by the sheet-discharge roller 62 and the spur 63.

As thus described, the recording sheet 50 is fed on the platen 43 by receiving the rotational force of at least one of the sheet-feed roller 60 and the sheet-discharge roller 62. In this time, since the sheet-feed roller 60 and the sheet-discharge roller 62 are intermittently driven, the recording sheet 50 is intermittently fed along the sheet-feed path 19. That is, a first processing in which the recording sheet 50 is fed by the target feeding amount and a second processing in which the recording sheet 50 is stopped for the predetermined period of time are alternately repeated. The image recording is performed by the recording portion 40 during performance of the second processing.

It is noted that the sheet-feed roller 60 and the sheet-discharge roller 62 do not need to be intermittently driven during a period in which the image recording is not performed by the recording portion 40. Thus, the sheet-feed roller 60 and the sheet-discharge roller 62 are continuously rotated before a recording operation by a recording head 42 is started and after the recording operation has been finished.

<Recording Portion 40>

The recording portion 40 is disposed above the platen 43 so as to face to the platen 43 with a predetermined space interposed therebetween. That is, the recording portion 40 is disposed on a downstream side of the pair of sheet-feed rollers 59 in the sheet-feed direction 124. The recording portion 40 includes the recording head 42 of ink-jet recording type and a carriage 41. The carriage 41 is configured so as to be movable in the width direction 121 (in a direction perpendicular to a sheet surface of FIG. 2). The recording head 42 is mounted on this carriage 41.

As shown in FIG. 3, a pair of guide frames 44, 45 are provided above the sheet-feed path 19 so as to be spaced at a predetermined distance in the sheet-feed direction 124. The guide frames 44, 45 extend in the width direction 121. The guide frame 44 is provided on an upstream side of the guide frame 45 in the sheet-feed direction 124. The carriage 41 is mounted on the guide frames 44, 45 so as to bridge the guide frames 44, 45. As a result, with reference to FIG. 2, the carriage 41 is disposed so as to face to the platen 43 with the sheet-feed path 19 interposed therebetween. It is noted that the guide frames 44, 45 are omitted in FIG. 2.

An upstream end portion of the carriage 41 in the sheet-feed direction 124 is slidably supported on an upper surface of the guide frame 44. A downstream end portion of the carriage 41 in the sheet-feed direction 124 is slidably supported on an upper surface of the guide frame 45. An end portion 39 of the guide frame 45 is formed by bending the guide frame 45 upward at a generally right angle and extends in the width direction 121. The carriage 41 nips and holds this end portion 39 by rollers and so on (not shown). As a result, the carriage 41 is movable in the width direction 121 with respect to the end portion 39.

As shown in FIG. 3, the upstream end portion of the carriage 41 in the sheet-feed direction 124 is provided with a contact member (piece) 33 horizontally projecting toward an upstream side of the sheet-feed direction 124. The carriage 41 is moved in the width direction 121, whereby the contact member 33 is moved in a direction the same as the direction in which the carriage 41 is moved. As will be explained below, an input lever 53 (with reference to FIG. 5) is disposed in an opening portion 52 (with reference to FIG. 3) of the guide frame 44 so as to project upward from the guide frame 44. The carriage 41 is moved in a second direction 112, whereby the contact member 33 is brought into contact with the input lever 53. As a result, a position of the input lever 53 in the width direction 121 is changed. An effect of this change of the position of input lever 53 in the width direction 121 will be described in detail below.

A belt driving mechanism 46 is provided on the upper surface of the guide frame 45. The belt driving mechanism 46 includes a drive pulley 47, a driven pulley 48, and a drive belt 49. The drive pulley 47 and the driven pulley 48 are respective provided near opposite ends of the upper surface of the guide frame 45 in the width direction 121. The drive belt 49 is an endless circular belt whose inner surface is provided with teeth, and wound around or supported between the drive pulley 47 and the driven pulley 48.

A CR motor 83 (with reference to FIG. 9) is connected to a shaft of the drive pulley 47. The drive pulley 47 is rotated by receiving a drive power of the CR motor 83. The drive belt 49 is circulated by this rotational force of the drive pulley 47. The carriage 41 is fixed to this drive belt 49 and thus moved in the width direction 121 by the circulation of the drive belt 49.

An encoder strip 51 is provided on the guide frame 45. The encoder strip 51 is provided or wound so as to extend over the end portion 39. The encoder strip 51 has a shape like a band and is formed of a transparent resin. The encoder strip 51 includes light intercepting portions each of which intercepts light and light transmitting portions each of which transmits light. The light transmitting portions and the light intercepting portions are alternately arranged at regular pitches so as to form a pattern. On the carriage 41 is mounted a photo interrupter, not shown, for detecting this pattern of the encoder strip 51.

With reference to FIG. 2, the recording head 42 has nozzles exposed from a back surface of the carriage 41. A plurality of the nozzles are arranged in the width direction 121 and in the depth direction 123. Ink is supplied to this recording head 42 from an ink cartridge, not shown, disposed in the printer section 11. During the movement of the carriage 41 in a scanning direction (i.e., the width direction 121), fine ink droplets are selectively ejected from the nozzles of the recording head 42 toward the platen 43. This series of the operations are performed in the above-mentioned second processing. That is, the recording head 42 records an image on the recording sheet 50 in each intermittent stop of the sheet-feed roller 60 and the sheet-discharge roller 62. Thus, the first processing and the second processing of the pair of sheet-feed rollers 59 and the pair of sheet-discharge rollers 64 are alternately repeated, whereby a continuous image is recorded on the recording sheet 50.

<First Encoder Disc 71 and Optical Sensor 55>

The first encoder disc 71 is provided on the shaft 76 of the sheet-feed roller 60. The first encoder disc 71 is like a transparent circular plate. Marks intercepting light are written at predetermined pitches in a circumferential direction of the first encoder disc 71. As shown in FIGS. 3-5, this first encoder disc 71 is fixed to the shaft 76 of the sheet-feed roller 60 and thus rotated with the sheet-feed roller 60. The optical sensor 55 includes a light emitting element and a light receiving element facing to each other in the width direction 121 with a predetermined distance therebetween. The optical sensor 55 is provided such that an outer edge of the first encoder disc 71 is positioned between the light emitting element and the light receiving element. When the light is received by the light receiving element of the optical sensor 55, an electric signal whose level is according to brightness or an intensity of the received light is produced by the optical sensor 55. Where any of the marks is located between the light emitting element and the light receiving element, an electric signal of low level is produced. Where any of the marks is not located between the light emitting element and the light receiving element, an electric signal of high level is produced. That is, a pulse signal is produced each time when any of the marks of the first encoder disc 71 is detected by the optical sensor 55. This pulse signal is outputted to the controller 100.

<Second Encoder Disc 72 and Optical Sensor 56>

A second encoder disc 72 (with reference to FIG. 4) is provided on a shaft (a second rotation shaft) 87 (with reference to FIG. 6) of the ASF motor 84. The second encoder disc 72 is like a transparent circular plate. Marks intercepting light are written at predetermined pitches in a circumferential direction of the second encoder disc 72. In the present embodiment, this second encoder disc 72 is fixed to the shaft 87 of the ASF motor 84. That is, the second encoder disc 72 is rotated with the shaft 87 in synchronization with the ASF motor 84 (the sheet-supply roller 25 and the sheet-supply roller 35). An optical sensor 56 includes a light emitting element and a light receiving element facing to each other in the width direction 121 with a predetermined distance therebetween. The optical sensor 56 is provided such that an outer edge of the second encoder disc 72 is positioned between the light emitting element and the light receiving element. When the light is received by the light receiving element of the optical sensor 56, an electric signal whose level is according to brightness or an intensity of the received light is produced by the optical sensor 56. Where any of the marks is located between the light emitting element and the light receiving element, an electric signal of low level is produced. Where any of the marks is not located between the light emitting element and the light receiving element, an electric signal of high level is produced. That is, a pulse signal is produced each time when any of the marks of the second encoder disc 72 is detected by the optical sensor 56. This pulse signal is outputted to the controller 100.

It is noted that the second encoder disc 72 may be fixed to a shaft different from the shaft 87 of the ASF motor 84. That is, the second encoder disc 72 may be fixed to a first transmission gear 91 which will be described below, for example, as long as the second encoder disc 72 is fixed to a shaft which is rotated in synchronization with the ASF motor 84.

<Drive-power Transmitting Mechanism 90>

Hereinafter, there will be explained the drive-power transmitting mechanism 90. The drive-power transmitting mechanism 90 selectively transmits the drive power of the ASF motor 84 to the sheet-supply roller 25 or the sheet-supply roller 35 and transmits the rotation of the sheet-feed roller 60 to the shaft 87 of the ASF motor 84. The drive-power transmitting mechanism 90 is provided on a frame constituted by the guide frames 44, 45 and so on. It is noted that this drive-power transmitting mechanism 90 is omitted in FIGS. 2 and 3.

As shown in FIG. 5, the drive-power transmitting mechanism 90 includes a motor gear 89, the first transmission gear 91, a second transmission gear 92, a connecting gear (a second gear) 95, the input lever 53, a third transmission gear 93, a fourth transmission gear 94, and a one-tooth gear (a first gear) 96. It is noted that although gear teeth are formed on the motor gear 89, a large-diameter portion 106 and a small-diameter portion 107 of the first transmission gear 91, the second transmission gear 92, the connecting gear 95, the third transmission gear 93, and the fourth transmission gear 94, these teeth are not shown in the figures.

The motor gear 89 is fixed to the shaft 87 of the ASF motor 84 and rotated integrally with the shaft 87 and the second encoder disc 72 about an axis extending in the width direction 121. The first transmission gear 91 is provided near the motor gear 89. The first transmission gear 91 is rotatable about an axis extending in the width direction 121. The first transmission gear 91 includes the large-diameter portion 106 and the small-diameter portion 107 whose outside diameters are different from each other. The large-diameter portion 106 of the first transmission gear 91 is meshed with the motor gear 89. The second transmission gear 92 is provided near the first transmission gear 91. The small-diameter portion 107 of the first transmission gear 91 is meshed with the second transmission gear 92. The second transmission gear 92 is rotatable about an axis extending in the width direction 121 like the motor gear 89 and the first transmission gear 91. This second transmission gear 92 is meshed with the first transmission gear 91 and the connecting gear 95.

The third transmission gear 93 and the fourth transmission gear 94 are provided on a lower side of the sheet-feed roller 60. The third transmission gear 93 and the fourth transmission gear 94 are individually rotatable about respective axes each extending in the width direction 121. Though not shown in the figures, the third transmission gear 93 is connected to the shaft 27 (with reference to FIG. 2) of the first supplying portion 28 such that the drive power transmitted to the third transmission gear 93 is transmittable to the shaft 27. The fourth transmission gear 94 is connected to the shaft 37 (with reference to FIG. 2) of the second supplying portion 38 such that the drive power transmitted to the fourth transmission gear 94 is transmittable to the shaft 37.

The one-tooth gear 96 is provided on the shaft 76 of the sheet-feed roller 60. The one-tooth gear 96 has one gear tooth 98 provided on an outer circumference surface of the shaft 76. The one-tooth gear 96 is located between the shaft 76 of the sheet-feed roller 60 and the shaft 87 of the ASF motor 84. These one-tooth gear 96, the third transmission gear 93, and the fourth transmission gear 94 are disposed such that positions of the gear teeth of the gears 93, 94, 96 in the width direction 121 are different from each other. In the present embodiment, the gears 93, 94, 96 are disposed such that the gear teeth of the third transmission gear 93, the gear teeth of the fourth transmission gear 94, and the gear tooth 98 of the one-tooth gear 96 are arranged in order from an inside of the MFD 10 toward an outside thereof in the width direction 121.

The connecting gear 95 is disposed between the second transmission gear 92 and the gears 93, 94, 96. In other words, the connecting gear 95 is disposed between the shaft 87 and the one-tooth gear 96. The connecting gear 95 is supported by a supporting shaft (a rotation shaft) 66 with the input lever 53 so as to be rotatable about the supporting shaft 66 and slidable in the width direction 121. The supporting shaft 66 is fixed to a frame of the printer section 11 so as to extend in the width direction 121. Thus, the connecting gear 95 and the input lever 53 are movable in a direction the same as the direction in which the carriage 41 is moved (i.e., in the width direction 121). It is noted that a width of the second transmission gear 92 in the width direction 121 is set so as to be larger than a range in which the connecting gear 95 is moved. Thus, the connecting gear 95 is always meshed with the second transmission gear 92 regardless of a position of the connecting gear 95 in the width direction 121. The connecting gear 95 is meshable with the third transmission gear 93, the fourth transmission gear 94, or the one-tooth gear 96 in a state in which the connecting gear 95 is meshed with the second transmission gear 92.

The input lever 53 is located on an outside of the connecting gear 95 in the width direction 121. The input lever 53 includes (a) a tubular cylindrical portion 57 fitted on the supporting shaft 66 and (b) an input portion 54 projecting from the cylindrical portion 57 in a radial direction thereof. The cylindrical portion 57 is fitted on the supporting shaft 66 so as to be rotatable about the supporting shaft 66 and slidable on the supporting shaft 66 in the width direction 121. Where the cylindrical portion 57 is slid, the input portion 54 is slid in the same direction as the cylindrical portion 57. Where the cylindrical portion 57 is rotated, the input portion 54 is rotated in the same direction as the cylindrical portion 57.

As shown in FIG. 5, a supporting frame 68 is provided above the input lever 53. This supporting frame 68 is fitted in the opening portion 52 (with reference to FIG. 3) of the guide frame 44 and thus fixed to the guide frame 44. In the supporting frame 68 is formed an opening 69 into which the input portion 54 of the input lever 53 is inserted.

Figure 6:
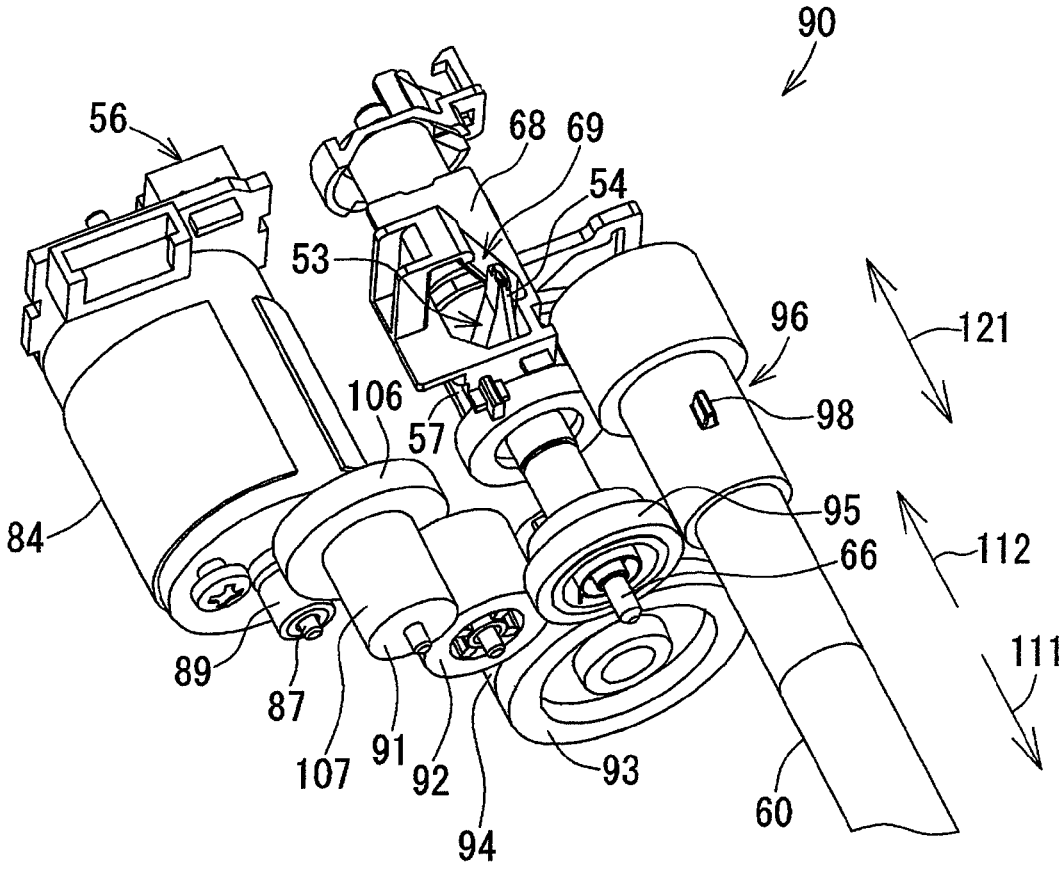
FIG. 6 is an enlarged perspective view of the drive-power transmitting mechanism 90 in a state in which an input portion 54 of an input lever 53 is disposed at a first position.
Figure 7:
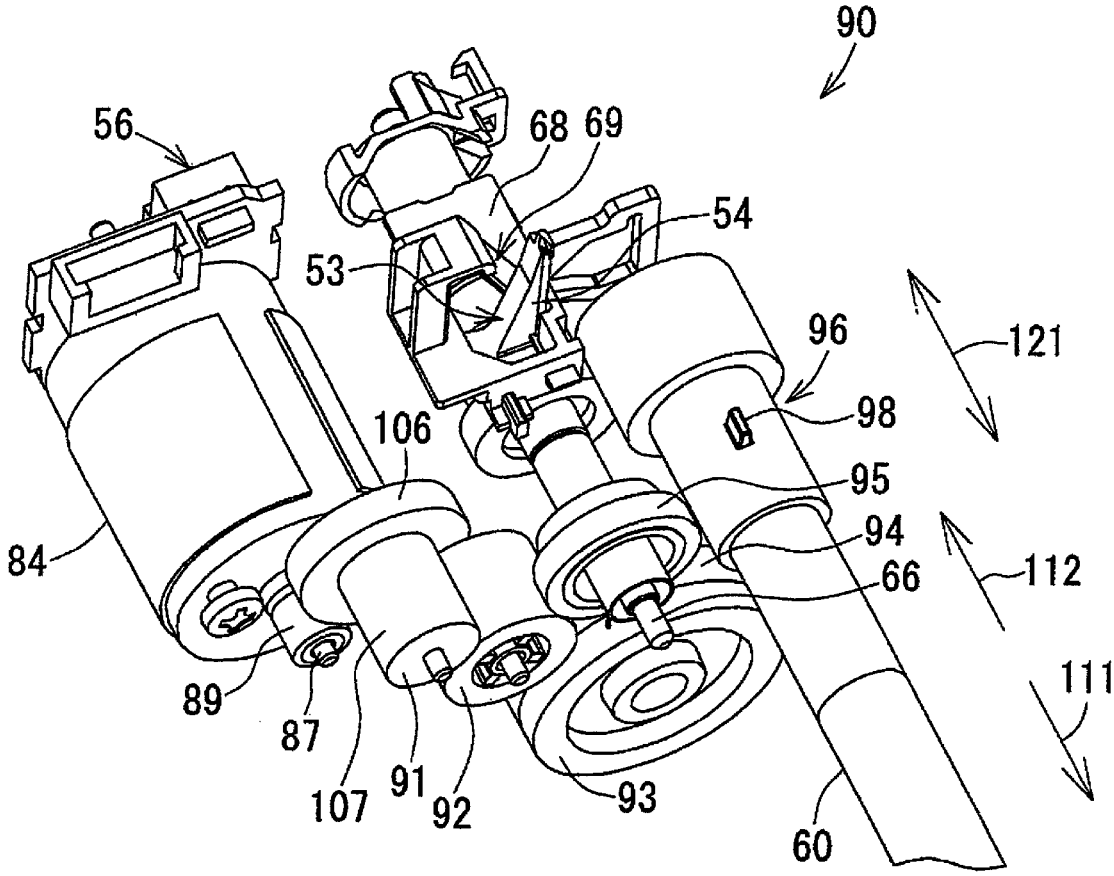
FIG. 7 is an enlarged perspective view of the drive-power transmitting mechanism 90 in a state in which the input portion 54 of the input lever 53 is disposed at a second position.
Figure 8:
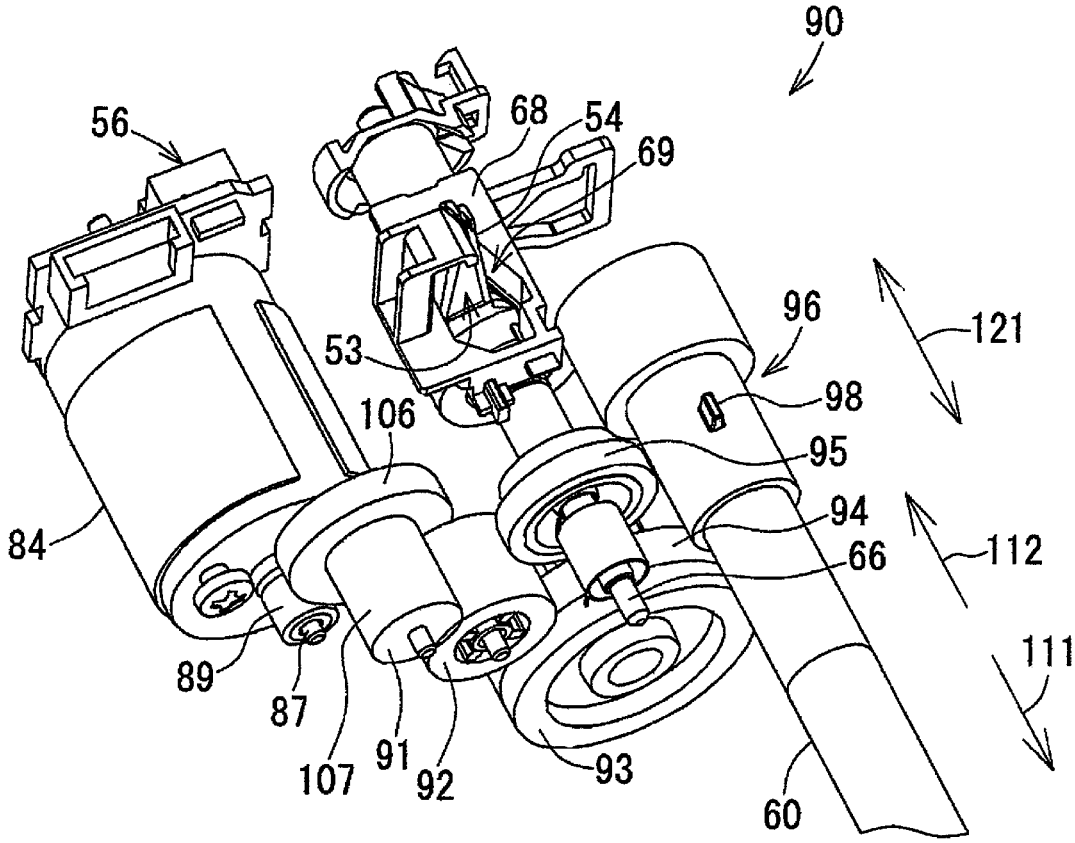
FIG. 8 is an enlarged perspective view of the drive-power transmitting mechanism 90 in a state in which the input portion 54 of the input lever 53 is disposed at a third position.

Although not shown in the figures, the connecting gear 95 is biased by a first coil spring, not shown, toward the input lever 53 (i.e., in the second direction 112). The input lever 53 is biased by a second coil spring, not shown, toward the connecting gear 95 (i.e., in a first direction 111). That is, the connecting gear 95 and the input lever 53 are biased in the directions opposite to each other. A biasing force of the second coil spring is made larger than that of the first coil spring. Thus, in a state in which no external force is applied to the input lever 53, the first coil spring is compressed by the biasing force of the second coil spring, whereby the connecting gear 95 and the input lever 53 are slid in the first direction 111. Then, where the input portion 54 of the input lever 53 is brought into contact with an end portion of the opening 69 of the supporting frame 68, the connecting gear 95 and the input lever 53 is limited to be moved in the first direction 111 (with reference to FIG. 6). As a result, the input portion 54 of the input lever 53 is disposed at a first position. That is, the input portion 54 is disposed at the first position in a state in which the input portion 54 does not receive a force from the carriage 41. As shown in FIG. 6, in a state in which the input portion 54 is disposed at the first position, the connecting gear 95 is meshed with the third transmission gear 93. Where the ASF motor 84 is driven in this state, the drive power of the ASF motor 84 is transmitted to the motor gear 89, the large-diameter portion 106 and the small-diameter portion 107 of the first transmission gear 91, the second transmission gear 92, the connecting gear 95, and the third transmission gear 93 in order. Since the third transmission gear 93 is connected to the sheet-supply roller 25, the sheet-supply roller 25 is rotated.

Where the carriage 41 is moved in the second direction 112, and the contact member 33 (with reference to FIG. 3) is brought into contact with the input portion 54 of the input lever 53, the input portion 54 is moved from the first position to a second position (with reference to FIG. 7) by receiving a pressing force of the contact member 33. Accordingly, the connecting gear 95 is moved in the second direction 112 by an elastic force of the first coil spring. As a result, the connecting gear 95 takes a state in which the connecting gear 95 is meshed with the fourth transmission gear 94. Where the ASF motor 84 is driven in this state, the drive power of the ASF motor 84 is transmitted to the motor gear 89, the large-diameter portion 106 and the small-diameter portion 107 of the first transmission gear 91, the second transmission gear 92, the connecting gear 95, and the fourth transmission gear 94 in order. Since this fourth transmission gear 94 is connected to the sheet-supply roller 35, the sheet-supply roller 35 is rotated.

Where the carriage 41 is further moved in the second direction 112, the input portion 54 of the input lever 53 is moved from the second position to a third position (with reference to FIG. 8) by the pressing force of the contact member 33. Accordingly, the connecting gear 95 is moved in the second direction 112 by the elastic force of the first coil spring. As a result, the connecting gear 95 is disposed at a position at which the connecting gear 95 is meshable with the one-tooth gear 96. Where the LF motor 85 is driven in this state, the sheet-feed roller 60 is rotated. Since the one-tooth gear 96 is provided on the shaft 76 of the sheet-feed roller 60, when the gear tooth 98 of the one-tooth gear 96 and the gear teeth of the connecting gear 95 are meshed with each other, the rotation of the sheet-feed roller 60 is transmitted to the connecting gear 95. The rotational force of the connecting gear 95 is transmitted to the second transmission gear 92, the small-diameter portion 107 and the large-diameter portion 106 of the first transmission gear 91, the motor gear 89, and the shaft 87 of the ASF motor 84 in order. As a result, the shaft 87 of the ASF motor 84 is rotated. That is, the second encoder disc 72 is rotated. It is noted that since the only one gear tooth 98 of the one-tooth gear 96 is provided on the outer circumference surface of the shaft 76 of the sheet-feed roller 60, the rotation of the sheet-feed roller 60 is transmitted to the shaft 87 of the ASF motor 84 in a predetermined rotation phase with one rotation of the sheet-feed roller 60 as one cycle. That is, where the sheet-feed roller 60 is rotated in one cycle, the shaft 87 is rotated and stopped in the same cycle.

As thus described, whether the rotation of the sheet-feed roller 60 is transmitted to the shaft 87 of the ASF motor 84 or not can be selectively changed by changing a position of the input portion 54 of the input lever 53. In other words, the input portion 54 of the input lever 53 as a changing portion can selectively change a transmitting state of the drive-power transmitting mechanism 90 between a transmitting state in which the rotation of the sheet-feed roller 60 is transmitted to the shaft 87 and a non-transmitting state in which the rotation of the sheet-feed roller 60 is not transmitted to the shaft 87.

<Controller 100>

Figure 9:
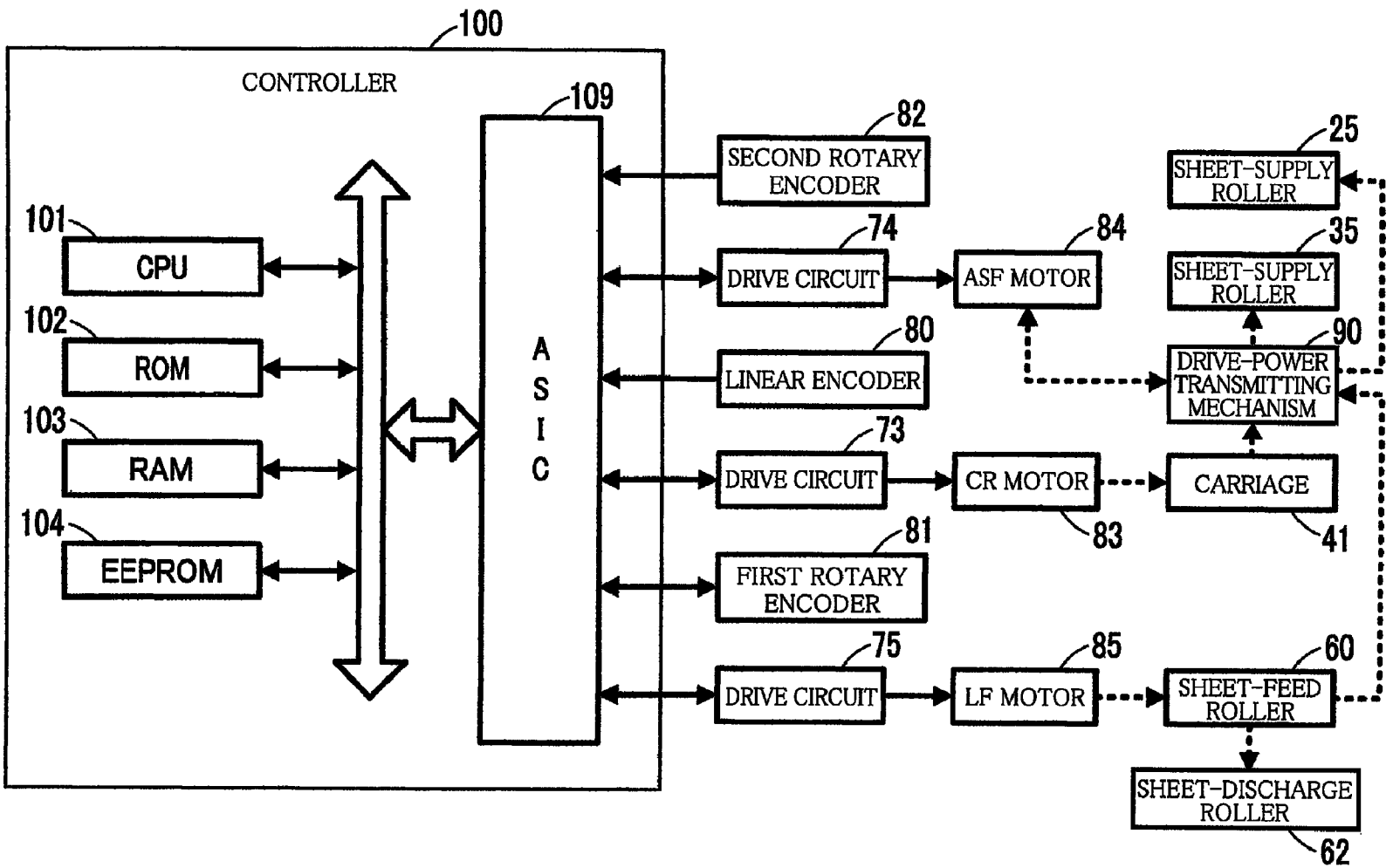
FIG. 9 is a block diagram showing an example of a configuration of a controller 100.

The controller 100 (with reference to FIG. 9) is configured to generally control not only the printer section 11 but also overall operations of the MFD 10. As shown in FIG. 9, the controller 100 is constituted by a microcomputer mainly including a CPU 101, a ROM 102, a RAM 103, an EEPROM 104, and an Application Specific Integrated Circuit (ASIC) 109. It is noted that FIG. 9 shows transmitting paths of the drive powers from the motors 83, 84, 85 in broken lines.

The ROM 102 stores programs and the like used where the CPU 101 controls the motors 83, 84, 85 and the MFD 10. The RAM 103 is used as a storing area for temporarily storing various data used when the CPU 101 executes the programs, and used as a working area for data processings and so on. The RAM 103 stores a current rotation phase of the sheet-feed roller 60 (hereinafter referred to as a "current phase θ"). This current phase θ is updated as appropriate in each rotation of the sheet-feed roller 60. The EEPROM 104 stores settings, flags, and so on which are to be kept also after the MFD 10 is turned off. This EEPROM 104 stores as a storing portion a correction value function A(θ) which will be described below. The correction value function A(θ) is a function in which is defined a relationship between a rotation phase of the sheet-feed roller 60 and a correction value of a feeding amount of the recording sheet 50 per the rotation phase of the sheet-feed roller 60.

To the ASIC 109 are connected a drive circuit 74, the second rotary encoder 82, a drive circuit 73, a linear encoder 80, a drive circuit 75, and the first rotary encoder 81. It is noted that the scanner section 12, the operation panel 14, and so on are connected to the controller 100, but these are not directly relevant to the present invention, and thus a detailed explanation thereof is dispensed with.

The drive circuit 74 is for driving the ASF motor 84. The ASF motor 84 is connected to the sheet-supply roller 25 or the sheet-supply roller 35 via the drive-power transmitting mechanism 90. The drive circuit 74 forwardly rotates the shaft 87 of the ASF motor 84 by receiving an output signal from the ASIC 109. The ASF motor 84 is forwardly rotated in the state in which the input portion 54 of the input lever 53 is disposed at the first position. As a result, the drive power of the ASF motor 84 is transmitted to the sheet-supply roller 25, so that the sheet-supply roller 25 is rotated. The uppermost one of the recording sheets 50 in the sheet-supply cassette 22 is supplied to the sheet-feed paths 18, 19 by receiving the rotational force of the sheet-supply roller 25. The shaft 87 of the ASF motor 84 is forwardly rotated in the state in which the input portion 54 of the input lever 53 is disposed at the second position. As a result, the drive power of the ASF motor 84 is transmitted to the sheet-supply roller 35, so that the sheet-supply roller 35 is rotated. The uppermost one of the recording sheets 50 in the sheet-supply cassette 21 is supplied to the sheet-feed path 17, 19 by receiving the rotational force of the sheet-supply roller 35.

With reference to FIG. 2, the second rotary encoder 82 includes the second encoder disc 72 and the optical sensor 56. The second rotary encoder 82 outputs the pulse signal in each time when a slit of the second encoder disc 72 is detected by the optical sensor 56. The controller 100 judges or detects a rotation amount of the shaft 87 of the ASF motor 84 by counting the pulse signal to control the driving of the ASF motor 84.

As will be described later, where the LF motor 85 is driven in the state in which the input lever 53 is disposed at the third position, the rotation of the sheet-feed roller 60 is transmitted to the shaft 87 of the ASF motor 84 via the drive-power transmitting mechanism 90. Since the one-tooth gear 96 is provided in the drive-power transmitting mechanism 90, the rotation amount of the shaft 87 of the ASF motor 84 is temporarily changed during the rotation of the sheet-feed roller 60. The controller 100 detects an origin position of the rotation phase of the sheet-feed roller 60 on the basis of a change of the rotation amount of the shaft 87 of the ASF motor 84, which rotation amount has been detected by the second rotary encoder 82. That is, the controller 100 functions as an origin-position detecting portion.

Meanwhile, the ASF motor 84 is connected to the sheet-supply rollers 25, 35 via the drive-power transmitting mechanism 90 and a one-way mechanism, not shown. Thus, where the ASF motor 84 is reversely rotated, the sheet-supply rollers 25, 35 are not rotated, so that the recording sheet 50 is not supplied from the sheet-supply cassettes 21, 22. A processing for detecting the origin position of the rotation phase of the sheet-feed roller 60 is performed while reversely rotating the shaft 87 of the ASF motor 84 by the drive power of the LF motor 85. Thus, in performing the processing for detecting the origin position, the recording sheet 50 is not uselessly supplied from the sheet-supply cassettes 21, 22. It is noted that the processing for detecting the origin position of the rotation phase of the sheet-feed roller 60 will be described in detail later on the basis of a flow-chart in FIG. 13.

The drive circuit 73 drives the CR motor 83 by receiving the output signal from the ASIC 109. The drive power of the CR motor 83 is transmitted to the carriage 41 via the belt driving mechanism 46. As a result, the carriage 41 is moved in the width direction 121.

The linear encoder 80 is for detecting the encoder strip 51 by the photo interrupter mounted on the carriage 41. The controller 100 controls the driving of the CR motor 83 on the basis of a detected signal of the linear encoder 80. The movement of the carriage 41 is controlled by the controller 100, whereby the input portion 54 of the input lever 53 is disposed at the first position (with reference to FIG. 6), the second position (with reference to FIG. 7), or the third position (with reference to FIG. 8). As a result, the transmission of the drive power by the drive-power transmitting mechanism 90 is changed.

The drive circuit 75 is for driving the LF motor 85. To the LF motor 85 are connected the shaft 76 of the sheet-feed roller 60 and the shaft 78 of the sheet-discharge roller 62 via gears and so on, not shown. The drive circuit 75 drives the LF motor 85 by receiving the output signal from the ASIC 109. The drive power of the LF motor 85 is transmitted to the shafts 76, 78, so that the sheet-feed roller 60 and the sheet-discharge roller 62 are simultaneously rotated. The recording sheet 50 supplied to the sheet-feed path 19 is fed along the sheet-feed path 19 by receiving the rotational force of the sheet-feed roller 60 or the sheet-discharge roller 62, and then is discharged onto the upper surface 23 of the sheet-supply cassette 22.

With reference to FIG. 4, the first rotary encoder 81 includes the first encoder disc 71 and the optical sensor 55. The first rotary encoder 81 outputs the pulse signal in each time when a slit of the first encoder disc 71 is detected by the optical sensor 55. The controller 100 judges or detects a rotation amount of the sheet-feed roller 60 by counting the pulse signal to control the driving of the LF motor 85.

Figure 10A:
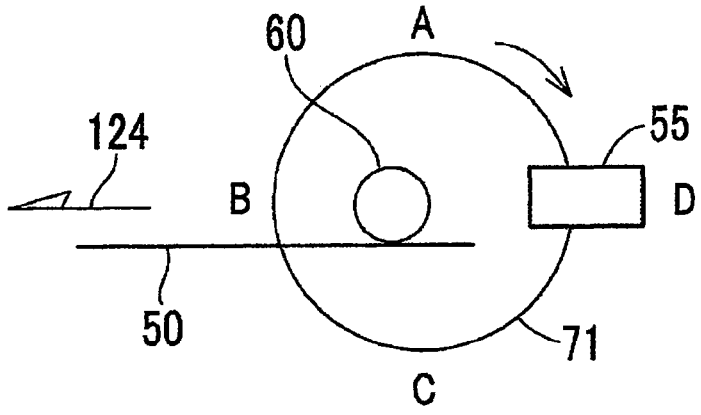
FIGS. 10A and 10B are for explaining a periodical change of an amount of feeding of a recording sheet 50.
Figure 10B:
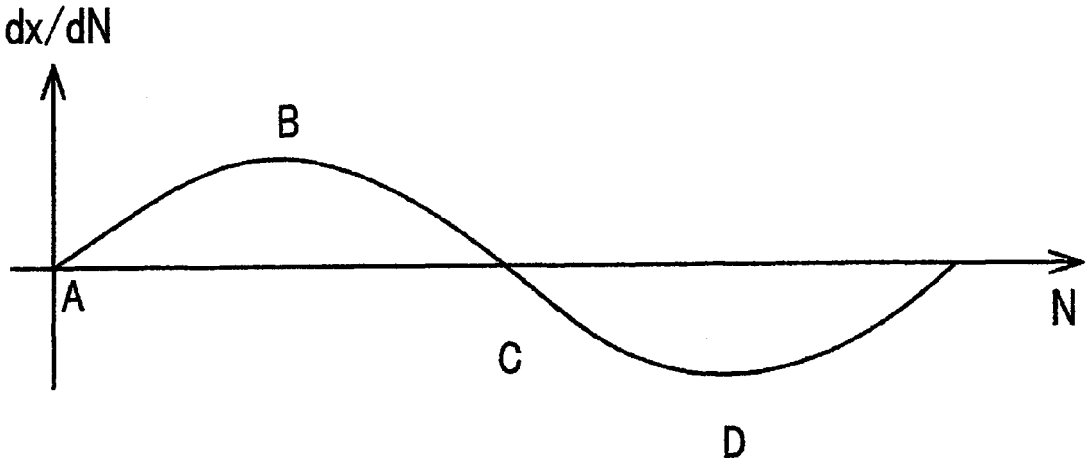

Meanwhile, in order to feed the recording sheet 50 at a relatively high accuracy, it is preferable that a linearity is provided between the rotation amount of the sheet-feed roller 60 which is detected by the first rotary encoder 81 and an actual rotation amount of the sheet-feed roller 60. FIG. 10A shows a state in which the eccentric first encoder disc 71 is mounted on the shaft 76 of the sheet-feed roller 60. With reference to FIG. 10B, because of the eccentricity of the first encoder disc 71, warping and unevenness of a thickness of coating of the sheet-feed roller 60, and an eccentricity of a gear meshed with the shaft 76 of the sheet-feed roller 60, the rotation amount of the sheet-feed roller 60 detected by the first rotary encoder 81 per the rotation phase is periodically changed with one rotation of the sheet-feed roller 60 as one cycle. In an example shown in FIGS. 10A and 10B, the feeding amount of the recording sheet 50 per the pulse signal outputted from the first rotary encoder 81 in a state in which a position B of the first encoder disc 71 is being detected is large. In contrast, the feeding amount of the recording sheet 50 per the pulse signal outputted from the first rotary encoder 81 in a state in which a position D of the first encoder disc 71 is being detected is small. As thus described, the feeding amount of the recording sheet 50 by the sheet-feed roller 60 is periodically changed.

Thus, in order to restrain the periodical change of the feeding amount by the sheet-feed roller 60, the controller 100 controls the driving of the LF motor 85 to correct the rotation amount of the sheet-feed roller 60 such that the rotation amount becomes even. That is, the controller 100 functions as a correcting portion. The EEPROM 104 stores the correction value function A(θ) used for correcting the rotation amount. Hereinafter, there will be explained the processing for obtaining the correction value function A(θ). It is noted that the correction value function A(θ) is obtained before shipments of the MFD 10 from factories, and stored or written in the EEPROM 104 in advance. However, the correction value function A(θ) may be written in the EEPROM 104 by the user performing a predetermined operation according to an instruction manual or a command displayed on the operation panel 14 when the user starts to use the MFD 10.

<Obtaining of Correction Value Function A(θ)>

In the present embodiment, the sheet-feed roller 60 is configured such that the recording sheet 50 is fed by the sheet-feed roller 60 by 1.2 inches when one rotation of the second encoder disc 72 is made. Further, a density of the nozzles of the recording head 42 in the sheet-feed direction 124 is 150 dpi, and when one rotation of the first encoder disc 71 is made, 8460 pulse signals are outputted from the first rotary encoder 81.

Figure 11A:
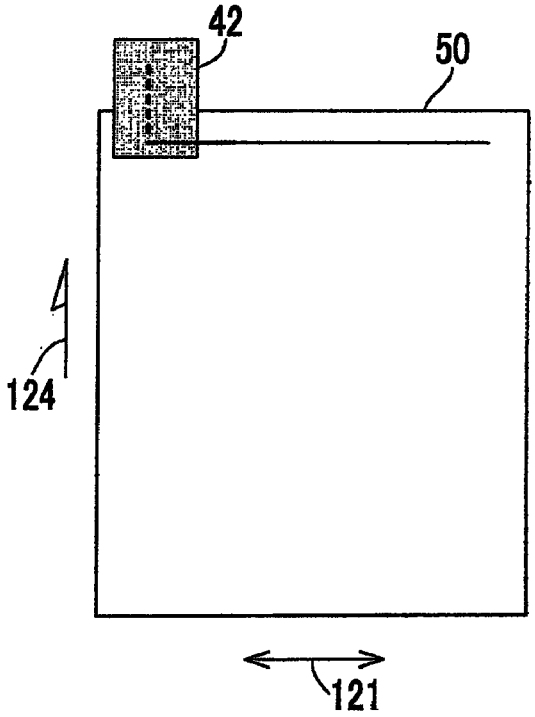
FIGS. 11A-11D are views each for explaining a processing for obtaining a correction value function A(θ)

The controller 100 controls the driving of the ASF motor 84 to supply the recording sheet 50 from the sheet-supply cassette 21 or the sheet-supply cassette 22 to the sheet-feed path 19. Then, with reference to FIG. 11A, the controller 100 controls the operation of the recording portion 40 to draw, at a leading end portion of the recording sheet 50, a long line extending in the width direction 121. Specifically, the controller 100 causes the ink to be ejected from ones (first nozzles) of the nozzles of the recording head 42 which ones are located on the most upstream side in the sheet-feed direction 124, while moving the carriage 41 by a first distance from one end to the other end in the width direction 121. As thus described, when one long line is drawn at the leading end portion of the recording sheet 50, the controller 100 controls the driving of the LF motor 85 to feed the recording sheet 50 by the pulse signal corresponding to 0.57 inches. Specifically, the controller 100 drives the LF motor 85 until 4104 (=8640×0.57/1.2) pulse signals are outputted from the first rotary encoder 81, and causes the recording sheet 50 to be fed by the sheet-feed roller 60. The LF motor 85 is stopped after the number of the pulse signals outputted from the first rotary encoder 81 reaches 4104.

Figure 11B:
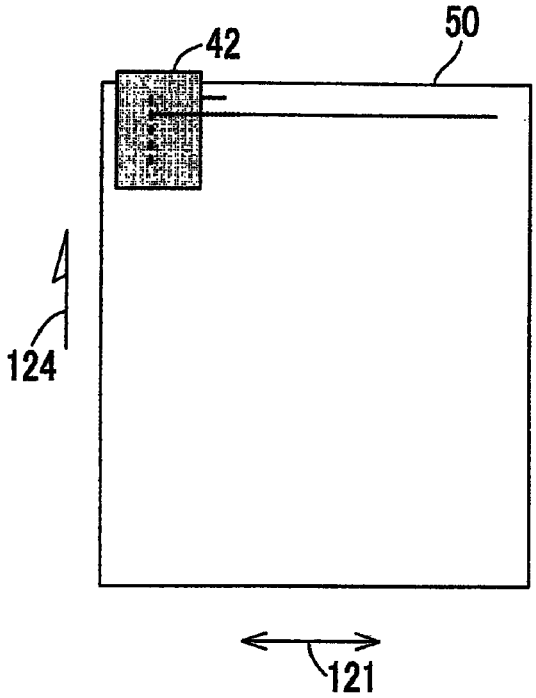
Figure 11C:
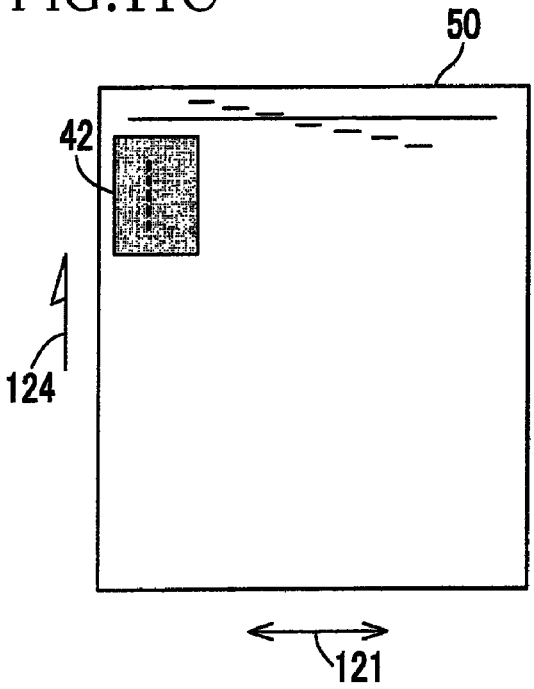
Figure 11D:
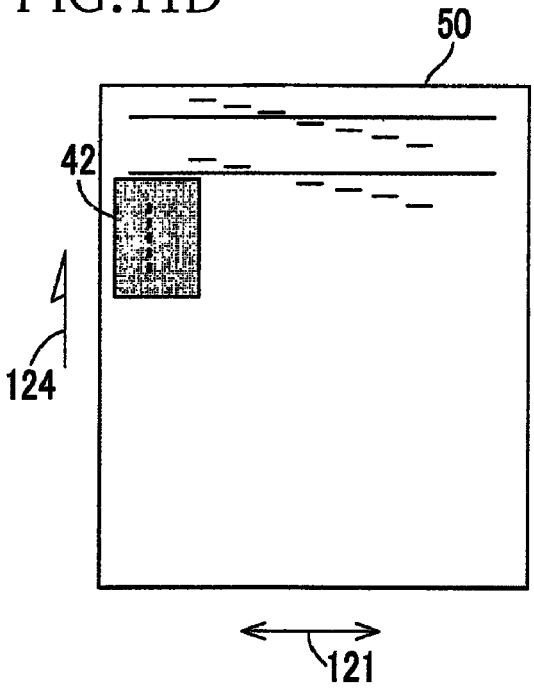

Next, with reference to FIG. 11B, a short line extending in the width direction 121 is drawn. Specifically, the controller 100 causes the ink to be ejected from ones (91st nozzles) of the nozzles of the recording head 42 from the most-upstream nozzles in the sheet-feed direction 124 while moving the carriage 41 from one end to the other end in the width direction 121 by a second distance which is shorter than the first distance. Since the density of the recording head 42 in the sheet-feed direction 124 is 150 dpi, a distance between the first nozzles and the 91st nozzles in the sheet-feed direction 124 is 0.6 (=(91−1)/150) inches. Thus, the 91st nozzles and the above-mentioned long line are ideally distant from each other in the sheet-feed direction 124 by 0.03 (=0.6–0.57) inches.

The controller 100 alternately repeats an operation in which the short line is drawn by the recording portion 40 and an operation in which the LF motor 85 is driven to feed the recording sheet 50 by the pulse signals (8640×0.01/1.2) corresponding to 0.01 inches. As a result, seven short lines are recorded on the recording sheet 50. It is noted that the recording operation by recording head 42 is performed while changing the position of the carriage 41 in the width direction 121 such that respective positions of these seven lines in the width direction 121 are different from one another.

Then, a processing is repeated in which the long line is recorded at a position advanced by 0.1 inches, and the seven short lines are recorded with respect to the long line. As a result, a total of twelve patterns are recorded on the recording sheet 50.

Next, the controller 100 judges what number of the short line is a short line overlapping the long line the best. Specifically, image reading of the recording sheet 50 is performed by the scanner section 12 in a state in which the recording sheet 50 is placed on the contact glass of the scanner section 12. Then, the controller 100 judges what number of the short line is a short line overlapping the long line the best. This judging processing is performed for each of the long lines. In the case of the recording sheet 50 shown in FIG. 12, the controller 100 can judge that values (numbers) are 3, 2.5, 2, 3, 4, 4, 5, 6, 6.5, 6, 4, 3.5 in order from the uppermost long line.

The first nozzles and the 91st nozzles are distant from each other in the sheet-feed direction 124 by 0.6 inches. Thus, where the above-mentioned value (number) is 4, it is indicated that the recording sheet 50 is actually fed by 0.6 (=0.57+0.01×(4–1)) inches with respect to the target feeding amount of 0.6 inches. Where the above-mentioned value (number) is 3, it is indicated that the recording sheet 50 is actually fed by 0.6 inches with respect to the target feeding amount of 0.59 (=0.57+0.01×(3–1)) inches. This indicates that the recording sheet 50 is fed by a portion of a circumferential surface of the sheet-feed roller 60, which portion is located on a "B" side in FIG. 10A. Where the above-mentioned value (number) is 5, it is indicated that the recording sheet 50 is actually fed by 0.6 inches with respect to the target feeding amount of 0.61 (=0.57+0.01×(5–1)) inches. This indicates that the recording sheet 50 is fed by a portion of the circumferential surface of the sheet-feed roller 60, which portion is located on a "D" side in FIG. 10A.

FIG. 10B (with reference to FIG. 12B) shows, on a lateral axis, pulse signals in increments of 1/12 (720 pulses) of one cycle, and shows, on a vertical axis, a proportion of a feeding amount per the pulse number to the target feeding amount. That is, it can be grasped how the feeding amount of the recording sheet 50 is deviated from the target feeding amount during one rotation of the sheet-feed roller 60.

Figure 12A:
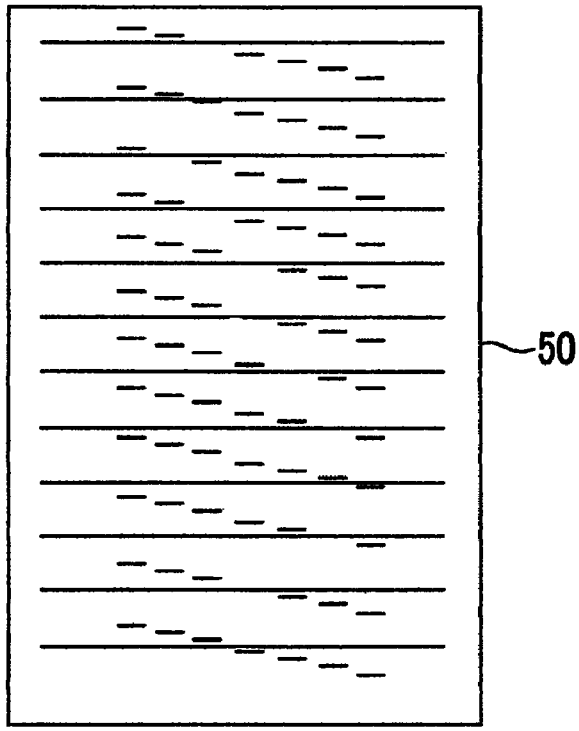
FIGS. 12A and 12B are views each for explaining the processing for obtaining the correction value function A(θ)

As long as the rotation of the sheet-feed roller 60 is detected by the first rotary encoder 81, it can be grasped how much the first encoder disc 71 has been currently rotated with respect to a rotation phase of the first encoder disc 71 upon initial recording of the long line at a time when the pattern shown in FIG. 12A is recorded on the recording sheet 50. Thus, when a command for feeding the recording sheet 50 is inputted, an average deviation of the feeding amount by the sheet-feed roller 60 from a current position thereof to a position thereof at a time when the feeding is finished can be calculated from the above-mentioned graph, and the target feeding amount can be corrected by previously taking into account an effect of the deviation. Where the calculation and the correction are performed, the periodical change of the feeding amount of the recording sheet 50 can be restrained.

Figure 12B:
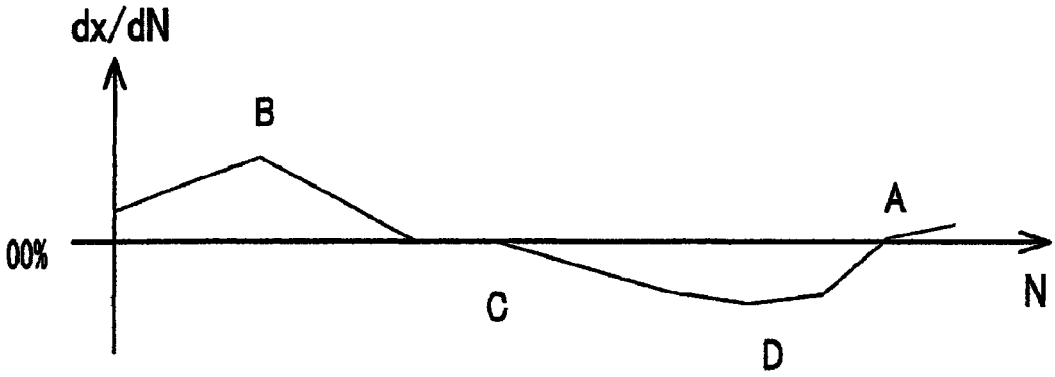

In the present embodiment, the correction value function A(θ) for correcting the target feeding amount of the recording sheet 50 is produced on the basis of the graph shown in FIG. 12B and stored in the EEPROM 104. Thus, even where a power of the MFD 10 is turned on again after being turned off, a physical origin point of the rotation phase of the sheet-feed roller 60 is detected, thereby making it possible to appropriately correct the rotation amount of the sheet-feed roller 60.

<Obtaining of Origin Position>

Figure 13:
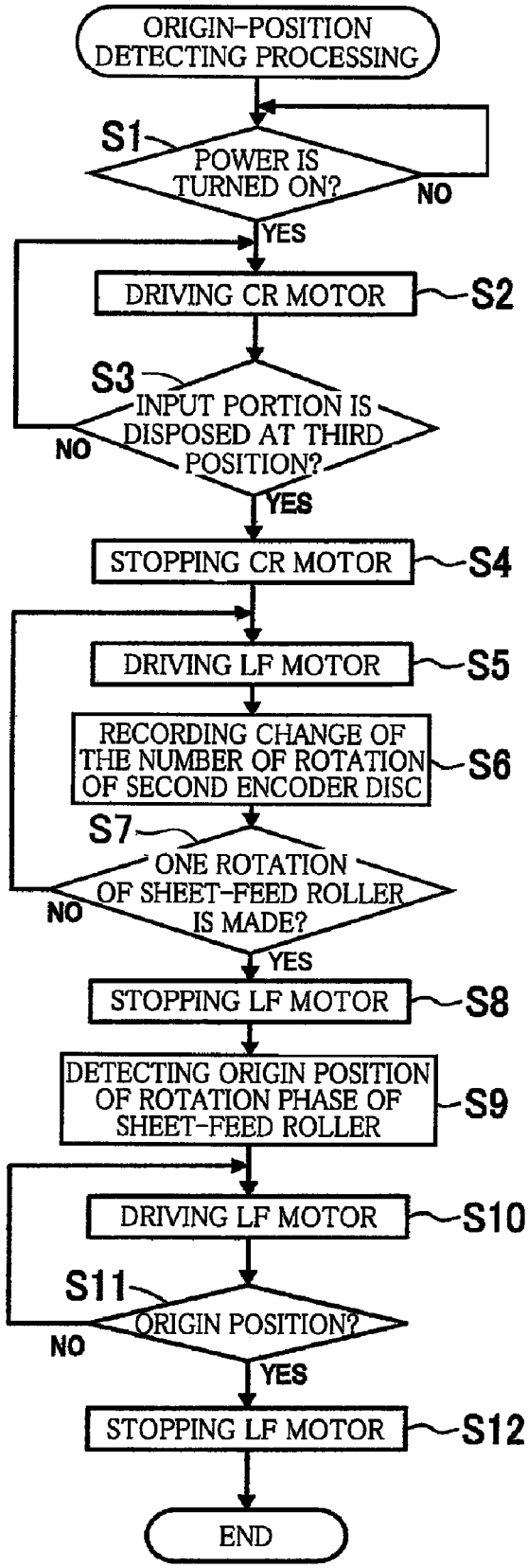

Hereinafter, there will be explained, on the basis of the flow-chart shown in FIG. 13, a procedure of a processing performed by the printer section 11 when the power of the MFD 10 is turned on. It is noted that each processing explained on the basis of the following flow-chart is performed according to a command issued from the controller 100 on the basis of the programs stored in the ROM 102.

Initially, the controller 100 judges in S1 whether the power of the MFD 10 is turned on or not on the basis of the presence or absence of an operation of predetermined input keys of the operation panel 14. Where the controller 100 has judged that the power of the MFD 10 is not turned on (S1: NO), the MFD 10 takes its waiting mode. Where the controller 100 has judged that the power of the MFD 10 is turned on (S1: YES), the controller 100 controls in S2 the drive circuit 73 to drive the CR motor 83. As a result, the carriage 41 is moved in the width direction 121. The controller 100 judges in S3 whether the input portion 54 of the input lever 53 is disposed at the third position (with reference to FIG. 8) or not on the basis of a result of the detection of the linear encoder 80. Where the controller 100 has judged that the input portion 54 is not disposed at the third position (S3: NO), the processing returns to S2. That is, the CR motor 83 is driven until the input portion 54 is disposed at the third position.

Where the controller 100 has judged that the input portion 54 of the input lever 53 is disposed at the third position (S3: YES), the controller 100 stops the CR motor 83 in S4. The controller 100 drives in S5 the LF motor 85 in a state in which the ASF motor 84 is not driven. When the LF motor 85 is driven, the one-tooth gear 96 provided on the shaft 76 of the sheet-feed roller 60 is rotated with the sheet-feed roller 60 and the sheet-discharge roller 62. Since the input portion 54 of the input lever 53 is disposed at the third position, the gear tooth 98 of the one-tooth gear 96 and the gear teeth of the connecting gear 95 are meshed with each other, and thereby the rotational force of the sheet-feed roller 60 is transmitted to the shaft 87 of the ASF motor 84 via the one-tooth gear 96, the connecting gear 95, the second transmission gear 92, the small-diameter portion 107 and the large-diameter portion 106 of the first transmission gear 91, and the motor gear 89, so that the second encoder disc 72 (with reference to FIG. 4) fixed to the shaft 87 is rotated.

Figure 14:
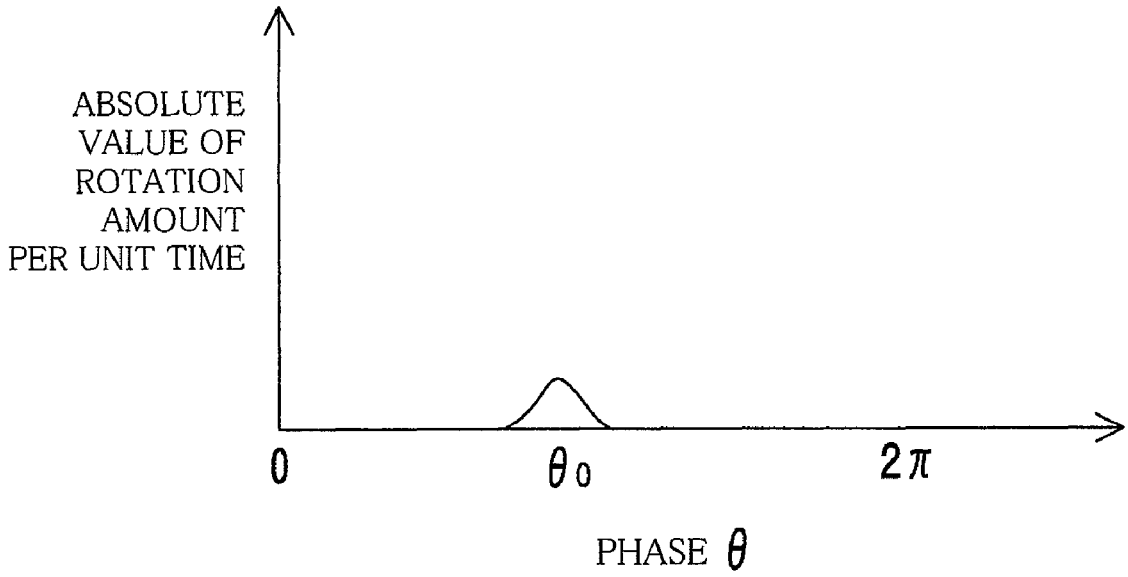
FIG. 14 is a graph showing an absolute value of an amount of rotation of a shaft 87 of an ASD motor 84 per unit time when a rotation of a sheet-feed roller 60 is transmitted to the shaft 87 via the drive-power transmitting mechanism 90.

During the driving of the LF motor 85, the controller 100 records in S6 a change of the number of the rotation of the second encoder disc 72. Specifically, the controller 100 monitors a change of the pulse signal outputted from the second rotary encoder 82 and temporality stores information about the change into the RAM 103. As shown in FIG. 14, this information is constituted by the rotation phase of the sheet-feed roller 60 and a rotation amount of the second encoder disc 72 which correspond to each other. Then, the controller 100 judges in S7 whether one rotation of the sheet-feed roller 60 is made or not on the basis of a result of the detection of the first rotary encoder 81. Specifically, the controller 100 judges whether the number of the pulse signal outputted from the first rotary encoder 81 has reached 8640 or not. Where the controller 100 has judged that one rotation of the sheet-feed roller 60 is not made (S7: NO), the processing returns to S5. That is, S5 and S6 are repeated until one rotation of the sheet-feed roller 60 is made.

Meanwhile, since the one-tooth gear 96 and the connecting gear 95 are not meshed with each other in a state that a portion of the one-tooth gear 96 in which the gear tooth 98 is not formed and the gear teeth of the connecting gear 95 face to each other, the rotation of the sheet-feed roller 60 is not transmitted to the shaft 87 of the ASF motor 84. Where the gear tooth 98 of the one-tooth gear 96 and the gear teeth of the connecting gear 95 are meshed with each other by the rotation of the sheet-feed roller 60, the rotation of the sheet-feed roller 60 is transmitted to the shaft 87 of the ASF motor 84. Thus, the rotation of the sheet-feed roller 60 is transmitted to the shaft 87 of the ASF motor 84 in each time when the sheet-feed roller 60 is rotated the number of rotation which corresponds to the one cycle (one rotation in the present embodiment). Thus, the shaft 87 of the ASF motor 84 (the second encoder disc 72) is rotated in each time when one rotation of the sheet-feed roller 60 is made, and the rotation is detected by the second rotary encoder 82. Then, a rotation phase 00 of the sheet-feed roller 60 (with reference to FIG. 14) at a time when the rotation of the second encoder disc 72 is detected by the second rotary encoder 82 is detected as the origin position by the controller 100. That is, the gear tooth 98 is formed at a position of an outer circumferential surface of the one-tooth gear 96, which position corresponds to the origin position of the sheet-feed roller 60.

Where the controller 100 has judged that one rotation of the sheet-feed roller 60 is made (S7: YES), the controller 100 stops the LF motor 85 in S8. Then, the controller 100 detects in S9 the origin position of the rotation phase of the sheet-feed roller 60. Specifically, on the basis of the information stored in the RAM 103 in S6, the controller 100 detects as the origin position the rotation phase $\theta_0$ of the sheet-feed roller 60 at a time when the absolute value of the rotation amount of the shaft 87 of the ASF motor 84 (the second encoder disc 72) per a unit time becomes the largest. This information indicating the origin position is stored into the RAM 103.

Subsequently, the controller 100 drives the LF motor 85 in S10. Then, the controller 100 judges in S11 whether the current rotation phase of the sheet-feed roller 60 takes the origin position on the basis of the result of the detection of the first rotary encoder 81 and the information indicating the origin position stored in the RAM 103. Where the controller 100 has judged that the rotation phase of the sheet-feed roller 60 does not take the origin position (S11: NO), the processing returns to S10. That is, the LF motor 85 is driven until the rotation phase of the sheet-feed roller 60 takes the origin position. Where the controller 100 has judged that the rotation phase of the sheet-feed roller 60 takes the origin position (S11: YES), the controller 100 stops the LF motor 85 in S12. In view of the above, the controller 100 can be considered to further include a first-rotation-body-position controlling portion configured to control the LF motor 85 to control a position of the sheet-feed roller 60 at a time before the recording portion starts the recording. Where the origin position has been detected, the first-rotation-body-position controlling portion sets the phase of the sheet-feed roller 60 as the origin position before the recording is started. The first-rotation-body-position controlling portion can be configured to perform the processings of S9-S12.

<Feeding Operation of Recording Sheet 50>

Figure 15:
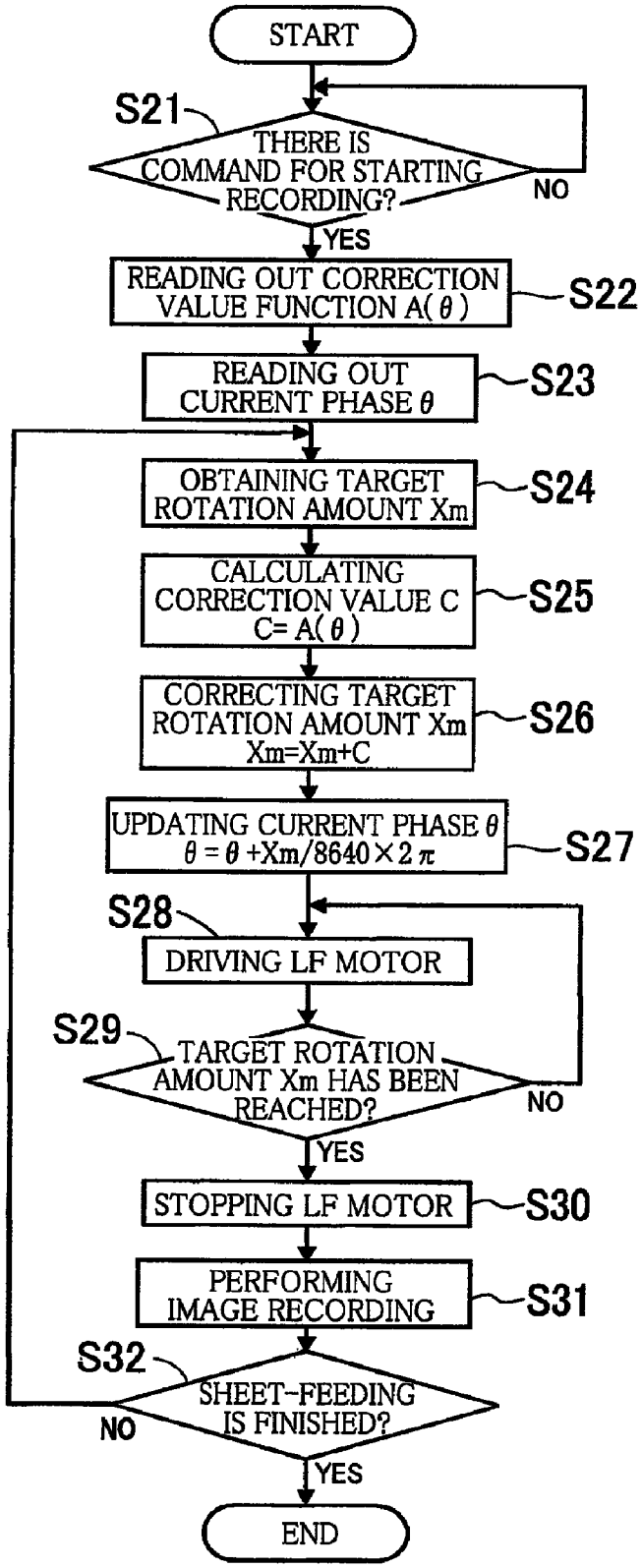
FIG. 15 is a flow-chart indicating an example of a procedure of a processing performed by the MFD 10 when a command for starting image recording is inputted.

There will be next explained, on the basis of a flow-chart in FIG. 15, a procedure of a processing performed by the printer section 11 where a command for starting the recording is inputted to the MFD 10.

The controller 100 judges in S21 whether there is the command for starting the recording or not. Specifically, the controller 100 judges whether a command for starting the recording and recording data are received from the external information device or not, or whether an input operation for commanding the start of the recording is performed in the operation panel 14 or not. Where the controller 100 has judged that there is no command for starting the recording (S21: NO), the MFD 10 takes its waiting mode.

Where the controller 100 has judged that there is the command for starting the recording (S21: YES), the correction value function $A(\theta)$ is read out from the EEPROM 104 in S22. Then, the controller 100 reads out in S23 the current phase $\theta$ of the sheet-feed roller 60 from the RAM 103. This current phase $\theta$ indicates an angle of the rotation of the sheet-feed roller 60. Next, the controller 100 obtains in S24 a target rotation amount Xm which is the number of the pulse signal outputted from the first rotary encoder 81 during feeding of the recording sheet 50 to a target position. Then, the controller 100 calculates in S25 a correction value C representative of the number of the pulse signal by substituting the current phase $\theta$ into the correction value function $A(\theta)$ read out in S22.

The controller 100 corrects in S26 the target rotation amount Xm by adding the correction value C to the target rotation amount Xm obtained in S24. Then, the controller 100 updates in S27 the current phase $\theta$ on the basis of the corrected target rotation amount Xm. It is noted that since the current phase $\theta$ is the angle of the rotation of the sheet-feed roller 60, where a value of the current phase $\theta$ exceeds $2\pi$, $2\pi$ is subtracted from the value. As a result, the value of the current phase $\theta$ is adjusted such that the current phase $\theta$ always satisfies a relationship of $0 \leqq \theta \leqq 2\pi$. It is further noted that, in view of the above, the controller 100 can be considered to include a rotation-phase calculating portion which calculates the rotation phase of the sheet-feed roller 60 on the basis of the corrected target rotation amount Xm and which performs the processing of S27.

Next, the controller 100 drives the LF motor 85 in S28. Then, the controller 100 judges in S29 whether the rotation amount of the sheet-feed roller 60 which has been detected by the first rotary encoder 81 has reached the target rotation amount Xm corrected in S26. Specifically, the controller 100 judges whether the number of the pulse signal outputted from the first rotary encoder 81 has reached the target rotation amount Xm or not. Where the controller 100 has judged that the rotation amount of the sheet-feed roller 60 has not reached the target rotation amount Xm (S29: NO), the processing returns to S28. That is, the LF motor 85 is driven until the rotation amount of the sheet-feed roller 60 reaches the target rotation amount Xm.

During the rotation of the sheet-feed roller 60, a periodic deviation whose one cycle is one rotation of the sheet-feed roller 60 is caused between the rotation amount of the sheet-feed roller 60 which is detected by the first rotary encoder 81 and the actual rotation amount of the sheet-feed roller 60. In the present embodiment, the current phase of the sheet-feed roller 60 is judged on the basis of the origin position of the sheet-feed roller 60 which is obtained after the power of the MFD 10 is turned on, and the target rotation amount Xm is corrected by the correction value C corresponding to the current phase. Since the driving of the LF motor 85 is controlled such that the rotation amount of the sheet-feed roller 60 is along the corrected target rotation amount Xm, the periodic deviation of the rotation amount of the sheet-feed roller 60 is balanced out, so that the recording sheet 50 is fed to a target position at a relatively high accuracy.

Where the controller 100 has judged that the rotation amount of the sheet-feed roller 60 has reached the target rotation amount Xm (S29: YES), the controller 100 stops the LF motor 85 in S30. Then, the controller 100 controls in S31 the recording portion 40 to perform the image recording. Specifically, the controller 100 controls the recording head 42 to eject the ink while moving the carriage 41 from one end to the other end in the width direction 121.

The controller 100 judges in S32 whether the feeding operation of the recording sheet 50 is finished or not. Where the controller 100 has judged that the feeding operation of the recording sheet 50 is not finished (S32: NO), the processing returns to S24. That is, S24-S29 are repeated. As a result, since the first processing in which the sheet-feed roller 60 is rotated by the target rotation amount Xm and the second processing in which the image is recorded on the recording sheet 50 are alternately repeated, the continuous image is recorded on the recording sheet 50. Where the controller 100 has judged that the feeding operation of the recording sheet 50 is finished (S32: YES), the controller 100 finishes the processing performed by the printer section 11 when the power of the MFD 10 is turned on.

<Effects of the Present Embodiment>

As explained above, in the printer section 11, the origin position of the rotation phase of the sheet-feed roller 60 is detected by using or diverting the second rotary encoder 82 which is for detecting the rotations of the sheet-supply rollers 25, 35. Thus, there is no need to newly provide, e.g., a sensor for detecting the origin position of the rotation phase of the sheet-feed roller 60. Thus, the origin position of the rotation phase of the sheet-feed roller 60 can be detected without upsizing of the apparatus and increase in cost.

Further, in the present embodiment, whether the rotation of the LF motor 85 is transmitted to the shaft 87 of the ASF motor 84 or not can be changed by the drive-power transmitting mechanism 90. That is, where the rotation of the LF motor 85 is transmitted to the shaft 87, the input portion 54 of the input lever 53 is disposed at the third position, whereby the sheet-feed roller 60 and the shaft 87 are connected to each other, so that the rotational force of the sheet-feed roller 60 is transmitted to the shaft 87. On the other hand, where the ASF motor 84 is driven, the connection between the sheet-feed roller 60 and the shaft 87 is released by the drive-power transmitting mechanism 90, so that the ASF motor 84 and the sheet-supply roller 25 (or the sheet-supply roller 35) are connected to each other such that the drive power of the ASF motor 84 is transmittable. Thus, the driving of the ASF motor 84 is not prevented by the processing for detecting the origin position of the rotation phase of the sheet-feed roller 60.

Further, in the present embodiment, the correction value C corresponding to the current rotation phase of the sheet-feed roller 60 is obtained on the basis of the origin position of the rotation phase of the sheet-feed roller 60 which has been detected by the controller 100 and the correction value function A(θ) stored in the EEPROM 104. The target rotation amount Xm is corrected by this correction value C. The sheet-feed roller 60 is rotated by this corrected target rotation amount Xm, whereby the periodical change of the feeding amount of the recording sheet 50 is restrained. As a result, the recording sheet 50 is intermittently fed at a generally regular linefeed width, and thus a non-distorted beautiful image can be recorded on the recording sheet 50.

It is noted that, in the present embodiment, the rotation amount of the sheet-feed roller 60 is detected by the first rotary encoder 81, but the rotation amount of the sheet-feed roller 60 may be detected by a magnetic sensor instead of the first rotary encoder 81, for example.

Further, in the present embodiment, the LF motor 85 is provided by the DC motor, but the LF motor 85 may be provided by a stepping motor. In this case, the first rotary encoder 81 is unnecessary.

Further, in the present embodiment, a rotation-body controlling apparatus and a sheet feeding apparatus according to the present invention are applied to the printer section 11, but the rotation-body controlling apparatus and the sheet feeding apparatus may be incorporated into the scanner section 12 to be used as a means for feeding the document (i.e., the AFD 29).

What is claimed is:

1. A rotation-body controlling apparatus comprising:

a first motor configured to rotate a first rotation body;

a second motor configured to rotate a second rotation body;

a first rotation amount detecting portion configured to detect a rotation amount of the first rotation body rotated in synchronization with the first motor;

a second rotation amount detecting portion configured to detect a rotation amount of a rotation shaft rotated in synchronization with the second rotation body;

a transmitting mechanism configured such that a rotation of the first rotation body is transmittable to the rotation shaft;

a changing portion configured to selectively change a state of the transmitting mechanism between (a) a transmitting state in which the rotation of the first rotation body is transmitted to the rotation shaft and (b) a non-transmitting state in which the rotation of the first rotation body is not transmitted to the rotation shaft;

a target-rotation-amount obtaining portion configured to obtain a target rotation amount of the first rotation body;

an origin-position detecting portion configured to detect an origin position of a rotation phase of the first rotation body on the basis of a phase of the first rotation body at a time when the second rotation amount detecting portion has detected a rotation of the rotation shaft, where the state of the transmitting mechanism is changed to the transmitting state by the changing portion;

a current-rotation-phase determining portion configured to determine a current rotation phase of the first rotation body on the basis of the origin position detected by the origin-position detecting portion; and a target-rotation-amount correcting portion configured to correct the target rotation amount determined on the basis of the current rotation phase determined by the current-rotation-phase determining portion.

2. The rotation-body controlling apparatus according to claim 1, wherein the transmitting mechanism is configured to transmit the rotation of the first rotation body to the rotation shaft with one rotation of the first rotation body as one cycle.

3. The rotation-body controlling apparatus according to claim 1, wherein the transmitting mechanism includes a first gear disposed between the first rotation body and the rotation shaft.

4. The rotation-body controlling apparatus according to claim 3, wherein the first gear has only one tooth formed on an outer circumferential surface of the first gear, and wherein the one tooth is formed at a position of the outer circumferential surface of the first gear, which position corresponds to the origin position of the rotation phase of the first rotation body.

5. A rotation-body controlling apparatus comprising:

a first motor configured to rotate a first rotation body;

a second motor configured to rotate a second rotation body;

a first rotation amount detecting portion configured to detect a rotation amount of the first rotation body-rotated in synchronization with the first motor;

a second rotation amount detecting portion configured to detect a rotation amount of a rotation shaft rotated in synchronization with the second rotation body;

a transmitting mechanism configured such that a rotation of the first rotation body is transmittable to the rotation shaft; and an origin-position detecting portion configured to detect an origin position of a rotation phase of the first rotation body on the basis of a phase of the first rotation body at a time when the second rotation amount detecting portion has detected a rotation of the rotation shaft, where the rotation of the first rotation body operated by the first motor is transmitted to the rotation shaft via the transmitting mechanism;

wherein the transmitting mechanism includes a first gear disposed between the first rotation body and the rotation shaft, wherein the first gear has one tooth formed on an outer circumferential surface of the first gear, wherein the one tooth is formed at a position of the outer circumferential surface of the first gear, which position corresponds to the origin position of the rotation phase of the first rotation body, wherein the rotation-body controlling apparatus further comprises a changing portion configured to selectively change a state of the transmitting mechanism between (a) a transmitting state in which the rotation of the first rotation body is transmitted to the rotation shaft and (b) a non-transmitting state in which the rotation of the first rotation body is not transmitted to the rotation shaft;

wherein the changing portion includes a second gear disposed between the rotation shaft and the first gear, and wherein the second gear is configured to change, by being moved in a direction of a rotation axis of the second gear, the state of the transmitting mechanism between the transmitting state in which the second gear is meshed with the first gear and the non-transmitting state in which the second gear is not meshed with the first gear.

6. A sheet feeding apparatus, comprising:

the rotation-body controlling apparatus according to claim 5; and a sheet-placed portion on which a sheet is placed, wherein the second rotation body is a supplying roller configured to supply the sheet from the sheet-placed portion to a sheet-feed path, and wherein the first rotation body is a sheet-feed roller configured to feed the sheet along the sheet-feed path.

7. The sheet feeding apparatus according to claim 6, further comprising:

a storing portion configured to store a relationship between a rotation phase of the sheet -feed roller and a correction amount of a target rotation of the sheet-feed roller; and a correcting portion configured to control the first motor so as to correct a rotation amount of the sheet-feed roller, wherein the correcting portion is configured to control the first motor on the basis of the origin position detected by the origin-position detecting portion and the relationship stored in the storing portion.

8. The sheet feeding apparatus according to claim 7, wherein the correcting portion includes a rotation-phase calculating portion configured to calculate the rotation phase of the sheet-feed roller on the basis of the correction amount of the target rotation of the sheet-feed roller.

9. An image recording apparatus, comprising:

the sheet feeding apparatus according to claim 7; and a recording portion configured to record an image on the sheet and disposed on a downstream side of the sheet-feed roller in a direction in which the sheet is fed.

10. The image recording apparatus according to claim 9, further comprising a carriage on which the recording portion is mounted and which is moved in a direction perpendicular to the direction in which the sheet is fed, wherein the changing portion includes an input portion configured to change the state of the transmitting mechanism between the transmitting state and the non-transmitting state by being moved in the direction of the rotation axis of the second gear together with the second gear, and wherein the input portion is configured to be moved in a state in which the input portion receives a force from the carriage.

11. The image recording apparatus according to claim 10, wherein in a state in which the input portion does not receive the force from the carriage, the input portion is disposed at a first position at which the state of the transmitting mechanism is in the non-transmitting state, and wherein where the input portion is disposed at the first position, a rotation of the second motor is transmitted to the supplying roller via the second gear.

12. The image recording apparatus according to claim 11, wherein the sheet-placed portion includes a first sheet-placed portion and a second sheet-placed portion disposed in a vertical direction, wherein the supplying roller includes (a) a first supplying roller provided in the first sheet-placed portion and (b) a second supplying roller provided in the second sheet-placed portion, wherein in the state in which the input portion receives the force from the carriage, the input portion is disposed at a second position which is different from the first position and at which the state of the transmitting mechanism is in the non-transmitting state, wherein where the input portion is disposed at the first position, the rotation of the second motor is transmitted to the first supplying roller via the second gear, and wherein where the input portion is disposed at the second position, the rotation of the second motor is transmitted to the second supplying roller via the second gear.

13. The image recording apparatus according to claim 10, wherein in the state in which the input portion receives the force from the carriage, the input portion is disposed at a third position which is different from the first position and the second position, and at which the state of the transmitting mechanism is in the transmitting state.

14. The image recording apparatus according to claim 13, wherein the origin-position detecting portion is configured to detect the origin position of the rotation phase of the first rotation body in a state in which the input portion is disposed at the third position.

15. The image recording apparatus according to claim 14, further comprising a first-rotation-body-position controlling portion configured to control the first motor to set a position of the first rotation body at a time before the recording portion starts the recording, wherein where the origin position has been detected by the origin-position detecting portion, the first-rotation-body-position controlling portion is configured to set the phase of the first rotation body as the origin position before the recording is started.

* * * * *